US007300052B2

(12) United States Patent
Tamura et al.

(10) Patent No.: US 7,300,052 B2
(45) Date of Patent: Nov. 27, 2007

(54) SHEET-SHAPED MEDIUM PROCESSING APPARATUS

(75) Inventors: Masahiro Tamura, Ohta-ku (JP); Akihito Andoh, Ohta-ku (JP); Shuuya Nagasako, Ohta-ku (JP); Kazuya Tsutsui, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/087,695

(22) Filed: Mar. 24, 2005

(65) Prior Publication Data

US 2005/0189706 A1 Sep. 1, 2005

Related U.S. Application Data

(63) Continuation of application No. 10/015,634, filed on Dec. 17, 2001, now Pat. No. 6,871,851.

(30) Foreign Application Priority Data

Dec. 15, 2000 (JP) ..... 2000-381311

(51) Int. Cl.
*B65H 33/08* (2006.01)

(52) U.S. Cl. ..... 271/221; 271/220; 270/58.12

(58) Field of Classification Search ..... 271/220, 271/221, 222, 238; 414/791.2, 789.9, 78; 270/58.12
See application file for complete search history.

(56) References Cited

U.S. PATENT DOCUMENTS 4,073,391 A 2/1978 O'Brien et al.
4,905,979 A * 3/1990 Limbach et al. ..... 271/176
5,263,697 A 11/1993 Yamazaki et al.
5,384,634 A * 1/1995 Takehara et al. ..... 399/410
5,508,798 A 4/1996 Yamada
5,618,035 A * 4/1997 Coombs et al. ..... 271/213
5,692,411 A 12/1997 Tamura
5,762,328 A 6/1998 Yamada et al.
5,857,670 A * 1/1999 Jung ..... 270/58.12
6,145,825 A 11/2000 Kunihiro et al.
6,199,853 B1 3/2001 Andoh et al.
6,220,592 B1 * 4/2001 Watanabe et al. ..... 271/241

(Continued)

FOREIGN PATENT DOCUMENTS

JP 48-60275 7/1973

(Continued)

*Primary Examiner*—Patrick Mackey
*Assistant Examiner*—Kaitlin Joerger
(74) *Attorney, Agent, or Firm*—Oblon, Spivak, McClelland, Maier & Neustadt, P.C.

(57) ABSTRACT

A sheet-shaped medium processing apparatus of the present invention is provided with a pair of arranging members 102*a*, 102*b*, and these arranging members 102*a*, 102*b* have both arranging function for arranging paper S piled on a tray 12 after being discharged in a discharge direction "a" from a paper discharge roller 3 at only fixed position, and sorting/arranging function for arranging the papers S grouped together at different position in direction (direction perpendicular to paper face) perpendicular to the discharge direction "a" in every copy of grouping together predetermined number of the paper S. For that reason, it is possible to conduct sorting/arranging action by using small drive power and to arrange the paper S in high precision regardless of largeness of piled amount of the paper S on the tray 12.

18 Claims, 23 Drawing Sheets

U.S. PATENT DOCUMENTS

| | | | | |
|---|---|---|---|---|
| 6,231,039 | B1 | 5/2001 | Chung | |
| 6,231,045 | B1 | 5/2001 | Yamada et al. | |
| 6,264,191 | B1 | 7/2001 | Suzuki et al. | |
| 6,290,220 | B1 * | 9/2001 | Takehara et al. | 270/58.12 |
| 6,293,543 | B1 * | 9/2001 | Lawrence | 271/213 |
| 6,296,247 | B1 | 10/2001 | Tamura et al. | |
| 6,322,070 | B2 | 11/2001 | Yamada et al. | |
| 6,343,785 | B1 | 2/2002 | Yamada et al. | |
| 6,382,615 | B1 | 5/2002 | Ishiguro et al. | |
| 6,394,448 | B2 | 5/2002 | Suzuki et al. | |
| 6,416,052 | B2 | 7/2002 | Yamada et al. | |
| 6,494,449 | B2 | 12/2002 | Tamura et al. | |
| 6,494,453 | B1 | 12/2002 | Yamada et al. | |
| 6,685,180 | B2 * | 2/2004 | Saegusa et al. | 270/58.08 |
| 6,832,759 | B2 * | 12/2004 | Nagasako et al. | 271/222 |

FOREIGN PATENT DOCUMENTS

| | | | |
|---|---|---|---|
| JP | 61-155162 | | 7/1986 |
| JP | 62-8965 | | 1/1987 |
| JP | 62008965 | A | 1/1987 |
| JP | 62-046862 | | 2/1987 |
| JP | 62046863 | A | 2/1987 |
| JP | 01203161 | A | 8/1989 |
| JP | 9-301609 | | 11/1997 |
| JP | 2000-86064 | | 3/2000 |
| JP | 2000066064 | A | 3/2000 |
| JP | 2000-219408 | | 8/2000 |
| JP | 2001341927 | A | 12/2001 |

* cited by examiner (ARRANGEMENT POSITION)

SHEET-SHAPED MEDIUM PROCESSING APPARATUS

BACKGROUND OF THE INVENTION

1. Field of the Invention

The present invention relates to a sheet-shaped medium processing apparatus, an image forming apparatus and a sheet-shaped medium after-treatment apparatus.

2. Description of the Prior Art

In the sheet-shaped medium after-treatment apparatus and the image forming apparatus, which conduct after-treatment such as punch unit treatment of puncturing punch hole for filing on papers discharged from the image forming apparatus after image formation, staple treatment by using staple means, sealing treatment of a seal and so forth, the papers discharged from discharging means thereof are taken in on sheet piling means (hereinafter referred to as a tray). The piled papers are subjected to automatic arrangement for the sake of exploitation thereafter, however, degree of paper arrangement namely degree of precision of arrangement becomes problem.

In FIG. 25, which indicates one example of a conventional paper processing apparatus, sheet-shaped medium (hereinafter referred to as papers) S that is sent toward the paper processing apparatus along conveyance direction A after being subjected to image formation by using an image forming apparatus that is not illustrated, is introduced to one pair of paper discharge roller 3 as discharging means via a discharging sensor for detecting passage of the paper. A tray 12' is located in down below of the paper discharge roller 3. The paper S, which is discharged in the discharge direction "a" (direction at right angle to an axis line of the paper discharge roller 3 in approximate horizontal plane) to be prolongation of the conveyance direction from the paper discharge roller 3, falls toward obliquely downward falling direction B depending on inertia and own weight after rear end portion of the paper S leaves from the paper discharge roller 3, then the paper is piled on a shift tray 12'.

When there is no paper on the shift tray 12', the paper lands with free fall distance from upper surface of the shift tray 12' to a nip section of the paper discharge roller 3, while when the paper S is piled on surface of the shift tray 12', the paper lands with free fall distance L from the top surface of the piled paper S to the nip section.

Meanwhile, the paper processing apparatus possesses sorting function, in order to achieve this sorting function, the shift tray 12' is capable of reciprocating with predetermined amount of stroke (shift amount) necessary for the sorting in a shift direction "c" at right angle to the discharge direction "a" in the horizontal plane. The shift tray 12' capable of being slid, which is hold at a pedestal 4 extending in the shift direction "c", is made to reciprocate in the shift direction "c" on the pedestal 4 by using drive mechanism that is not illustrated, at the time of sorting.

Outline of sorting action is that the papers of predetermined number of sorting are piled on the shift tray 12' of being at a halt in one end of reciprocating of movement stroke of the reciprocating. For instance, in cases where several copies of the paper sheaf with 8 sheets of papers as a copy are made to sort to be piled, ① at the time that the shift tray 12' is located at one end of reciprocation, 8 sheets of papers are discharged to be piled continuously on the shift tray 12' from the paper discharge roller 3 sequentially. ② next, the shift tray 12' moves to the other end of the reciprocation, when the shift tray 12' is located at the other end of the reciprocation, the papers S are discharged to be piled thereon from the paper discharge roller 3. ③ After 8 sheets of papers are piled on the shift tray 12' at the other end of the reciprocation, the shift tray 12' moves to the one end of the reciprocation, and the same operation as the above ① is conducted.

And under, the same action is repeated until the paper sheaf corresponding to required number of copies are piled. As a result, on the shift tray 12', it is possible to obtain piled state that is one in which required copies of paper sheaf are sorted in such a way that steps of paper end surface between respective copies are sorted by concave-convex shaped steps corresponding to shift amount of the shift tray 12' with the paper sheaf of 8-sheet-one-set as one copy.

① However, in order to reciprocate the shift tray 12' in the shift direction "c" described above, it is necessary to provide drive means, as the drive means, for instance, a concave-convex-shaped section is formed at the rear end portion of the shift tray 12', and a concave-convex shaped section fitted into the above described concave-convex shaped section at an end-fence to be rear end receive portion of the paper, in which these respective concave-convex shaped sections are made gearing conditions, further, an eccentric pin is made to engage into a hole extended in the radius direction formed at part of the end-fence, and the eccentric pin is made to rotate by a motor.

At this case, it is possible to obtain necessary shift amount for the sorting in accordance with amount of eccentricity of the eccentric pin, however, since power to operate is different depending on the number of the paper (weight) piled on the shift tray 12', it is necessary to consider drive motor power of the tray, and the other mechanical parts on condition that maximum possible number of papers are piled, so, in the case of shift action for small number of the paper, it is impossible to use full power of the drive motor, resulting in design with low efficiency.

② In addition, in FIG. 25, the paper S discharged from the paper discharge roller 3 is simply piled on the shift tray 12' through being subjected to free fall within the space of free fall distance L. Namely, the paper S of departing from the paper discharge roller 3 is under free condition until the paper S is piled on the shift tray 12', so, lateral resist of the paper S received from the image forming apparatus is off to the side, or the paper is twisted with skew, so that paper end face in the shift direction "c" of the paper of being piled on the shift tray 12' does not line up among the papers resulting in occurrence of paper irregularity with lateral gap amount Δ.

Copy agency and so forth require pile with sorting condition of extremely precision because paper sheaves assorted to be piled are treated at next process, for instance the paper sheaves are treated by punch unit. If the paper sheaves are in sorting condition with bad precision, since punch unit processing should be conducted after the paper sheaves taken out from the shift tray 12' are made to arrange again by hands, so that waste occurs at the point of working efficiency. For that reason, copy agency and so forth require severe arrangement precision about piled paper, so improvement of arrangement precision is desired.

③ Followings are this kind of known technique.

(a) Official gazette of Japanese Patent Laid-Open No. HEI 10-245148 discloses technique in which there is provided two aligning members capable of moving independently at both sides of width direction at right angles to sheet transfer direction, and these aligning members execute two processing actions of sheet arranging processing in the width direction and shift processing of sorting the sheet in every number of copy, however, since the aligning member conducts two kinds of processing of the sheet arranging processing and the shift processing, mechanism is complicated.

(b) Official gazette of Japanese Patent Laid-Open No. HEI 5-286609 discloses technique in which sheet is discharged on a carriage capable of moving in a direction of traversing sheet discharge direction, and position of the sheet is aligned in such a way as to move the carriage until the sheet on the carriage is detected by a sensor, however, it is difficult to say that the technique is suitable for alignment of mutual piled many sheets.

(c) Official gazette of the patent (U.S. Pat. No. 2,761,221) discloses technique for aligning transfer paper on the paper discharge tray by use of jogger fence to be aligning means, however, since the technique is one for aligning the transfer paper on the paper discharge tray, it is impossible to conduct sorting.

(d) Official gazette of Japanese Utility Model Laid-Open No. HEI 5-10367 discloses technique in which there are provided two paper discharge side fences of standing upright oppositely on the paper discharge tray, and the paper is piled therebetween, so, respective insides of these side fences, there are provided guide sections capable of projecting and being evacuated, in which the paper discharged between side fences is made to curve by use of the guide sections under projected condition, thereafter, the paper is subjected to free-fall on the paper discharge tray with the guide sections evacuated, however, it is impossible to sort the paper.

SUMMARY OF THE INVENTION

In view of the foregoing, it is an object of the present invention to provide a sheet-shaped medium processing apparatus and an image forming apparatus capable of obtaining sorting/arranging function by using small drive power without relationship to various size of piled amount on piling means and capable of arranging the sheet-shaped medium in high precision.

The present invention adopts following configuration in order to achieve the above-described objects.

According to a first aspect of the present invention, there is provided a sheet-shaped medium processing apparatus which has a discharging means for discharging sheet-shaped medium of being transferred and a piling means for piling the sheet-shaped medium discharged from the discharging means, in which the sheet-shaped medium processing apparatus arranges to pile the sheet-shaped medium piled on the piling means, which comprises an arranging means of having two functions of arranging function for arranging the sheet-shaped medium piled on said piling means after discharged from said discharging means at only fixed position in the direction (shift direction) perpendicular to said discharge direction and of sorting/arranging function for arranging the sheet-shaped medium in every copy at different position in the direction (shift direction) perpendicular to said discharge direction.

By the above configuration, it is possible to conduct sorting/arranging action by using small drive power regardless of largeness of piled amount on piling means.

According to a second aspect of the present invention, in the first aspect, there is provided the sheet-shaped medium processing apparatus, wherein the arranging means is made up of a pair of arranging members and an arranging member driving device for operating the arranging members, and the arranging members have arranging sections that come into contact with end faces of the sheet-shaped medium in such a way as to put two end faces of the sheet-shaped medium in parallel to the discharge direction therebetween.

By this configuration, it is possible to enhance arranging precision in such a way not to conduct shift action of the tray, but to conduct action of arranging member due to arranging member driving device so as to arrange surely while contacting to sheet-shaped medium.

According to a third aspect of the present invention, in the second aspect, there is provided the sheet-shaped medium processing apparatus, wherein step shaped relief sections are formed at the head of the arranging sections in the arranging members with wider face-to-face interval than face-to-face interval of the arranging sections.

By this configuration, it is possible to arrange the paper while striking part of arranging member surely to end face of sheet-shaped medium in such a way as to adopt aspect of crossing part of arranging member to end face of sheet shaped medium surely via concave section.

According to fourth aspect of the present invention, in the third aspect, there is provided the sheet-shaped medium processing apparatus, wherein the face-to-face interval of relief section, in comparison with the face-to-face interval of arranging section, is wider interval than half of the shift amount at the time of the sorting/arranging function of arranging the sheet-shaped medium while shifting position only predetermined shift amount in the direction (shift direction) perpendicular to the discharge direction.

By this configuration, it is possible to avoid interference between the sheet-shaped medium thus discharged and arranging member at the time of sorting/arranging action.

According to a fifth aspect of the present invention, in the fourth aspect, there is provided the sheet-shaped medium processing apparatus, wherein the face-to-face interval of relief sections, in comparison with the face-to-face interval of arranging sections, is wider interval than interval in which inroad amount of the arranging members into inside of the sheet-shaped medium from the end face at the time of arranging the sheet-shaped medium is added to half of the shift amount at the time of the sorting/arranging function of arranging the sheet-shaped medium while shifting position only predetermined shift amount in the direction (shift direction) perpendicular to the discharge direction.

By this configuration, it is possible to avoid interference between discharged sheet-shaped medium and the arranging member even though when the sheet-shaped medium is arranged in such a way that the arranging member is made to cut into end face of the sheet-shaped medium.

According to a sixth aspect of the present invention, in the first aspect, there is provided the sheet-shaped medium processing apparatus, wherein, at the time of exhibiting the sorting/arranging function, the arranging means conducts arrangement of the ultimate sheet-shaped medium of respective copies, after that, moving in the direction (shift direction) perpendicular to the discharge direction to wait position for the sake of arrangement of next copy with condition evacuated upward.

By this configuration, it is possible to avoid interference the arranging member and the sheet-shaped medium after arrangement.

According to a seventh aspect of the present invention, in the first aspect, there is provided the sheet-shaped medium processing apparatus, wherein, at the time of exhibiting said sorting/arranging function, arrangement is conducted in such a way as to conduct actions in which one side of the arranging members is made not to move, and the other side of the arranging members reciprocates in the direction (shift direction) perpendicular to the discharge direction alternately in every copy.

By this configuration, it is possible to realize small sound condition in such a way that two arranging members are made to use alternately between not moved condition and moved condition, so consumption degree of member is reduced.

According to an eighth aspect of the present invention, in the seventh aspect, there is provided the sheet-shaped medium processing apparatus, wherein the wait position before action of the arranging member of the side of operating the arranging action is taken to be upper surface position within the range where the copy already aligned at previous time is positioned.

By this configuration, it is possible to prevent disturbance of the paper after previous time alignment, and also it is possible to improve the productivity.

According to ninth aspect of the present invention, in the seventh aspect, there is provided the sheet-shaped medium processing apparatus, wherein action of arrangement by using the arranging means is made to prohibit to initial sheet-shaped medium of the copy.

By this configuration, it is possible to permit shift arrangement without lowering productivity.

According to a tenth aspect of the present invention, in the first aspect, there is provided the sheet-shaped medium processing apparatus, wherein the one pair of arranging members is composed of plate shaped body in which the arranging sections are located at the most lowest section of the arranging members and opposite surface with each other are composed of plane surfaces perpendicular to the shift direction.

By this configuration, it is possible to arrange the sheet-shaped medium while approaching/departing arranging section to/from end face of the sheet-shaped medium piled on the piling means surely in such a way as to move the arranging member in shift direction. In addition, plate shape body is adopted, thus, compact configuration is realized.

According to an eleventh aspect of the present invention, in the first aspect, there is provided the sheet-shaped medium processing apparatus, wherein the arranging means have a moving means of the arranging members of moving in approaching/departing direction independently in which the moving means causes one side of the one pair of arranging members to move to the other side, or vice versa.

By this configuration, it is possible to adopt one side movement aspect in which one side of arranging member is not moved while the other side is moved in arranging action.

According to a twelfth aspect of the present invention, in the eleventh aspect, there is provided the sheet-shaped medium processing apparatus, wherein concave sections are formed at the upper surface of the piling means so that parts of the one pair of arranging members capable of being placed downwards than the upper surface of the piling means.

By this configuration, it is possible to arrange the paper while striking part of arranging member surely to end face of sheet-shaped medium in such a way as to adopt aspect of crossing part of arranging member to end face of sheet shaped medium surely via concave section.

According to a thirteenth aspect of the present invention, in the twelfth aspect, there is provided the sheet-shaped medium processing apparatus, wherein the concave sections have a size capable of accommodating the arranging members at the time the arranging member conduct the arranging action to the sheet shaped medium at the minimum size.

By this configuration, it is possible to operate the arranging member without interfering tray even though when the minimum size of the sheet-shaped medium is arranged.

According to a fourteenth aspect of the present invention, in the twelfth aspect, there is provided the sheet-shaped medium processing apparatus, wherein the concave sections have a size capable of accommodating the one pair of arranging members even though at the time the arranging members move in the direction (shift direction) perpendicular to the discharge direction in order to conduct the sorting/arranging action.

By this configuration, it is possible to avoid interference between the tray and the arranging members even though when the arranging member moves for sorting/arranging action.

According to a fifteenth aspect of the present invention, in the twelfth aspect, there is provided the sheet-shaped medium processing apparatus, wherein when the sheet shaped medium is not piled on the piling means, the sheet-shaped medium is discharged from the discharging means under the condition that part of the one pair of arranging members is located downward than piled surface of the sheet-shaped medium of the piling means.

By this configuration, it is possible to arrange the sheet-shaped medium piled on the piling means in such a way as to move one pair of arranging members in the direction of approaching with each other under condition as it is.

According to a sixteenth aspect of the present invention, in the twelfth aspect, there is provided the sheet-shaped medium processing apparatus, wherein the arranging means have a supporting shaft for supporting the arranging members capable of being rotated and a restricting member for restricting rotation amount of the one pair of arranging members with the supporting shaft as center.

By this configuration, it is suitable that special positioning mechanism of rotational direction is not provided because fixed position of the one pair of arranging members are maintained automatically by own weight in such a way as to provide restricting member of rotation amount.

According to a seventeenth aspect of the present invention, in the sixteenth aspect, there is provided the sheet-shaped medium processing apparatus, wherein the one pair of arranging members is placed within the concave sections of upper surface of the piling means or arrangement operation position contacted to the top surface section of the sheet shaped medium piled on the piling means while rotating with moment by own weight.

By this configuration, it is possible to enter arranging action while moving the arranging member with condition maintained, in arranging action, in such a way as to place the arranging member at arrangement operation position.

According to an eighteenth aspect of the present invention, in the tenth aspect, there is provided the sheet-shaped medium processing apparatus, wherein when a position of departing from position that is one in which the one pair of arranging members come into contact with the top surface of the sheet-shaped medium piled on the piling means is taken to be an evacuation position, there is provided an evacuating means for evacuating the one pair of arranging members while rotating from the arrangement operation position to the evacuation position.

By this configuration, it is possible to avoid interference between the arranging member and the sheet-shaped medium in such a way as to place the arranging member at the evacuation position.

According to a nineteenth aspect of the present invention, in the tenth aspect, there is provided the sheet-shaped medium processing apparatus, which further comprises an ascent and descent means capable of going up and down the piling means, and a positioning means for determining position of the piling means in up-and-down direction due to the ascent and descent means at the discharge time of the sheet-shaped medium from the discharging means so that the upper surface of the piling means or position of up-and-down direction of the top surface of the sheet-shaped medium piled on the upper surface of the piling means becomes correct discharge position of being better suited for discharge for the sheet-shaped medium from the discharging means.

By this configuration, it is possible to discharge the sheet-shaped medium on upper surface of the piling means under the condition that variation of landing position is small.

According to a twentieth aspect of the present invention, in the tenth aspect, there is provided the sheet-shaped medium processing apparatus, wherein the one pair of arranging members are made from material whose coefficient of friction of parts to be respective lower end sections of contacting with the sheet-shaped medium is smaller than coefficient of friction of the sheet-shaped medium therebetween.

By this configuration, arranged condition of the sheet-shaped medium after arranging is not disturbed on the occasion of arranging action in such a way as to set friction coefficient of lower end section of the arranging member that is part of contacting the sheet-shaped medium smaller than friction coefficient of sheet-shaped medium with one another.

According to a twenty-first aspect of the present invention, in the tenth aspect, there is provided the sheet-shaped medium processing apparatus, wherein the one pair of arranging members is operated by an arranging member driving device, and the arranging member driving device includes a fulcrum shaft for supporting to engage the one pair of arranging members in which the fulcrum shaft is common to the one pair of arranging members, a push-movement shaft for rotating arranging members with the fulcrum shaft as center while contacting with respective action points on respective arranging members of being shifted from the fulcrum shaft, and a rotation stopping member capable of stopping rotation respectively due to rotational moment with the fulcrum shaft as center by own weight of the arranging members, in which said fulcrum shaft serves as a guide shaft for guiding respective arranging members in the arrangement direction, and the rotation stopping member serves as a driving means for moving the arranging members in the arrangement direction.

By this configuration, it is possible to contact the arranging member to upper surface of the sheet-shaped medium with load corresponding to rotational moment by gravity, so, contact pressure to the sheet-shaped medium is capable of being adjusted freely in such a way as to adjust this load, when there is no sheet-shaped medium, it is possible to place the arranging member within the concave section of the tray under engaged condition, thus it is possible to permit contact to the end face surely.

According to a twenty-second aspect of the present invention, in the twenty-first aspect, there is provided the sheet-shaped medium processing apparatus, which further comprises a switch-driving means for switching freely condition of conducting push-movement of respective the action points while acting on the push-movement shaft, and condition of releasing the push-movement by the push-movement shaft.

By this configuration, it is possible to switch between condition of evacuating from the top surface of the sheet-shaped medium and condition of contacting under rotational moment by gravity at the same time about respective arranging members.

According to a twenty-third aspect of the present invention, there is provided an image forming apparatus that has an image forming means for conducting image formation on sheet-shaped medium and a conveying means for conveying the sheet-shaped medium of being subjected to the image formation, which is provided with a sheet-shaped medium processing apparatus described in any one of the tenth aspect to the twenty-second aspect.

By this configuration, about an image forming apparatus, it is possible to conduct sorting/arranging action by using small drive power regardless of largeness of piling amount on the piling means.

According to a twenty-fourth aspect of the present invention, there is provided sheet-shaped medium after-treatment apparatus that has an after-treatment means for conducting after-treatment to sheet-shaped medium and a conveying means for conveying sheet-shaped medium of being subjected to the after-treatment, is provided with a sheet-shaped medium processing apparatus described in any one of the tenth aspect to twenty-second aspect.

By this configuration, it is possible to sort and arrange the sheet-shaped medium in high precision, in addition to after-treatment function after image formation.

BRIEF DESCRIPTION OF THE DRAWINGS

FIG. 2(*b*) is an outline perspective view of peripheral section of a sensor for controlling height of a tray;

FIG. 12(*b*) is an outline elevation view of the arranging member of being located at front side of the arrangement position at the time of sorting/arranging as seen from the side of the paper discharge roller;

FIG. 13(*b*) is an outline elevation view of the arranging member of being located at the rear side of arrangement position at the time of sorting/arranging as seen from the side of paper discharge roller;

FIG. 18(*b*) is an elevation view of the tray;

FIG. 19(*b*) is a flowchart for explaining main routine for arrangement action;

DETAILED DESCRIPTION OF THE PREFERRED EMBODIMENTS

Figure 1:
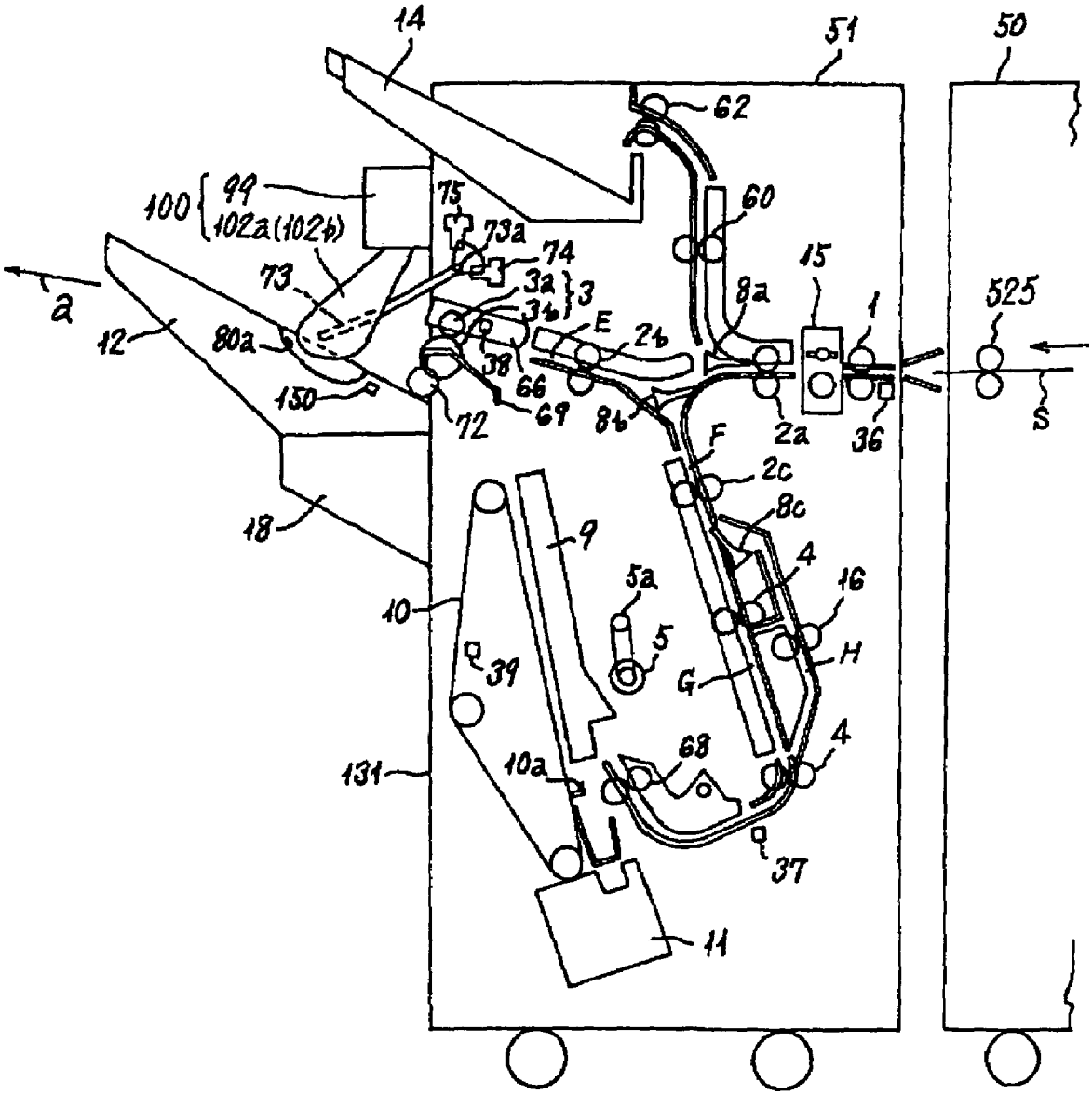
FIG. 1 is an outline configuration view of the sheet-shaped medium after-treatment apparatus and the image forming apparatus according to the present invention.

Various embodiments of the present invention will be described with reference to the accompanying drawings.

In this specification, as the sheet-shaped medium of being handled, copying papers, transfer papers, journal papers, front covers, partition papers, computer forms, special papers, OHP sheets, and so forth are contained in the sheet-shaped medium, however, in the description below, it is indicated by using the name of the paper on behalf thereof.

[1] General Outline of Sheet-Shaped Medium Processing Apparatus

A. The sheet-shaped medium processing apparatus according to the present invention is capable of being constituted as single apparatus (①), and it is possible to arrange and to sort the sheet-shaped medium on the tray by using arranging function and sorting/arranging function while combining integrally or combining to be connected another apparatus with means for discharging the sheet-shaped medium such as an image forming apparatus with no arranging function, a sheet-shaped medium after-treatment apparatus with no arranging function (②).

B. The sheet-shaped medium after-treatment apparatus according to the present invention includes after-treatment means for conducting after-treatment to the sheet-shaped medium and conveyance means for conveying the sheet-shaped medium of being subjected to after-treatment, and contents of the after-treatment are sealing, puncturing, staple processing and some kind or another process for the sheet-shaped medium.

An example in which the sheet-shaped medium processing apparatus integrated with the sheet-shaped medium after-treatment apparatus is connected with the image forming apparatus will be described in [2]. The sheet-shaped medium after-treatment apparatus is capable of selecting whether after-treatment is executed, and the sheet-shaped medium of being subjected to the after-treatment because the after-treatment execution is selected, as well as the sheet-shaped medium of being subjected to no after-treatment because the after-treatment execution is not selected are arranged on the tray and/or are sorted by using arranging function and sorting/arranging function of the sheet-shaped medium processing apparatus.

C. The image forming apparatus according to the present invention includes image forming means for conducting image formation to the sheet-shaped medium and conveyance means for conveying the sheet-shaped medium of being subjected to the image formation. The image forming apparatus is capable of being integrated with the sheet-shaped medium processing apparatus in the above "A.". The example thereof will be described in [4].

D. The single type sheet-shaped medium processing apparatus in the above "A." may be connected with the image forming apparatus or the sheet-shaped medium after-treatment apparatus via the conveyance means, however such a case will be capable of being realized easily depending on the above-described combination, therefore, explanation thereof will be omitted.

[2] Sheet-Shaped Medium After-Treatment Apparatus

[2]-1: General Outline of Sheet-Shaped Medium After-Treatment Apparatus

An example in which single sheet-shaped medium after-treatment apparatus connected with the image forming apparatus is integrated with the sheet-shaped medium processing apparatus will be described. In addition, an arranging member driving device that is constituted as sub unit of the sheet-shaped medium processing apparatus also will be described.

The sheet-shaped medium after-treatment apparatus according to the present invention includes after-treatment means for conducting after-treatment to the paper and conveyance means for conveying the paper of being subjected to the after-treatment, and contents of the after-treatment are sealing, puncturing, staple processing and some kind or another process for the sheet-shaped medium.

The sheet-shaped medium after-treatment apparatus is capable of selecting whether after-treatment is executed, and the paper of being subjected to the after-treatment because the after-treatment execution is selected, as well as the paper of being subjected to no after-treatment because the after-treatment execution is not selected are arranged with condition sorted on the tray by using the arranging action and sorting action of the sheet-shaped medium processing apparatus.

Consequently, it is possible to conduct arrangement and/or sorting while discharging and piling the paper on the tray with unit of paper sheaf due to staple processing. It should be noted that example will be made to explain in which the paper is discharged on the tray one by one.

FIG. 1 illustrates the whole constitution example of the sheet-shaped medium after-treatment apparatus 51 according to the present embodiment. The sheet-shaped medium after-treatment apparatus of the present embodiment is used in such a way that the sheet-shaped medium after-treatment apparatus is connected to be combined with another apparatus having means for discharging the paper, such as for example, an image forming apparatus 50 with no arranging function.

The paper S of being subjected to image formation at the image forming apparatus 50 arrives at the sheet-shaped medium after-treatment apparatus 51. It is possible to select whether after-treatment is made, and the paper of being subjected to the after-treatment according to selection or the paper of being subjected to no after-treatment according to selection is arranged on a tray 12 as piling means by using the sheet-shaped medium processing apparatus integrated with the sheet-shaped medium after-treatment apparatus 51, and, if necessary, the papers are arranged in such sorted state that position is made to shift in every predetermined number of sheets about shift direction "c" at right angle to discharge direction "a". This sorting/arranging will be described later.

In the image forming apparatus 50, the paper S of being subjected to image formation by using the image forming means while following contents of the after-treatment instructed by the operator are sent to the sheet-shaped medium after-treatment apparatus 51 by using a discharge roller 525.

As for contents of the after-treatment in the sheet-shaped medium after-treatment apparatus 51, there are following modes when the image forming apparatus 50 is a copying machine: ① Normal mode of piling the paper only in discharged order; in this mode, processing is executed in such a way as to instruct paper size and the number of copying. ② Staple mode of conducting staple processing; in this mode, processing is executed in such a way as to instruct the number of filing, filing position and so forth except for the paper size and the number of copying, thus the staple processing is conducted with paper unit of being more than 2 sheets. ③ Arrangement mode of arranging the papers at fixed position on the shift direction "c". ④ Sorting/arranging mode for conducting sorting processing; in this mode, processing is executed in such a way as to instruct paper size and the number of sorting sheaf. And ⑤ Punch mode; in this mode, puncturing is conducted.

Work instruction in connection with these after-treatment is communicated to control means including CPU depending on key manipulation from operation panel of the image formation apparatus 50, thus the after-treatment is executed in such a way that signal communication of fulfillment of the after-treatment is conducted between the image forming apparatus 50 and the sheet-shaped medium after-treatment apparatus 51.

As illustrated in FIG. 1, the sheet-shaped medium after-treatment apparatus 51 has the up-and-down movable tray 12 and a proof tray 14 as a position fixed tray at the top of the apparatus.

At vicinity of paper transferring section between the sheet-shaped medium after-treatment apparatus 51 and the image forming apparatus 50, there is provided an entrance sensor 36 and an entrance roller pair 1, and the paper of being taken in using the entrance roller pair 1 via the discharge roller 525 of the image forming apparatus 50 is conveyed along respective conveyance route depending on after-treatment mode.

A punch unit 15 for conducting perforation is provided at the lower reaches of a stream from the entrance roller pair 1, and a conveyance roller pair 2*a* is provided at the lower reaches of the stream from the punch unit 15. A brunch claw 8*a* is provided at the lower reaches of the stream from the conveyance roller pair 2*a*, thus the papers are guided selectively to conveyance route of proceeding to the proof tray 14 or to conveyance route of proceeding approximately horizontally. When being conveyed toward the proof tray 14, the paper is conveyed by a conveyance roller pair 60, and the paper is discharged to the proof tray 14 by using a paper discharge roller pair 62.

A branch claw 8*b* is provided at the lower reaches of the stream from the branch claw 8*a*, thus the paper is guided selectively to a non staple route E or a staple route F. The branch claws 8*a*, 8*b* are capable of being changed their positions depending on ON/OFF control of solenoid that is not illustrated.

The paper guided to the non staple route E is conveyed by using a conveyance roller pair 2*b*, then the paper is discharged to the tray 12 by using a pair of paper discharge roller 3 as discharging means. A returning roller 72 for retuning the paper on the tray 12 to an end fence 131 is provided in such a way as to overlap onto lower portion of the paper discharge roller 3.

The paper discharge roller 3 has an upper roller 3*a* and a lower roller 3*b*, and the lower roller 3*b* is supported at the free end portion of a supporting member 66, with rotatable condition, which the supporting member 66 is provided while being supported the upper reaches of a stream in the paper discharged direction "a" with rotatable condition in up-and-down direction. The lower roller 3*b* comes into contact with the upper roller 3*a* due to own weight or energized force, the paper is put between both rollers to be discharged. When paper sheaf of being subjected to staple processing is discharged, the supporting member 66 is moved to be rotated, then being returned with the predetermined timing. The timing is determined on the basis of detection signal of a discharged paper sensor 38.

The paper guided to the staple route F is conveyed by using a conveyance roller pair 2*c*. A branch claw 8*c* is provided at the lower reaches of the stream from the conveyance roller pair 2*c*, and the paper is guided selectively to a staple main route G or to an evacuation route H depending on the branch claw 8*c*. Also the branch claw 8*c* is capable of being changed its position depending on ON/OFF control of solenoid that is not illustrated.

The paper guided to the staple main route G is piled on a staple tray that is not illustrated while being detected by a discharged paper sensor 37 via a conveyance roller pair 4 by using a paper discharge roller pair 68. In this case, arrangement is conducted in the longitudinal direction (paper conveyance direction) by use of a beating roller 5 in every paper, and arrangement is conducted in the shift direction "c" (also referred to as paper width direction) by using a jogger fence 9. At discontinuity of job, namely, during the period from the last paper of the paper sheaf to the top paper of the next paper sheaf a stapler 11 is driven by staple signal from control means that is not illustrated, thus filing processing is conducted.

In cases where next paper is sent while the filing processing is conducted since distance between the papers of being discharged from the image forming apparatus 50 is short, the next papers are guided to the evacuation route H and being evacuated temporarily. The papers guided to the evacuation route H are conveyed by using a conveyance roller pair 16.

The paper sheaf of being subjected to the staple processing is sent immediately to the paper discharge roller 3 via a guiding member 69 by using an ejecting belt 10 provided with an ejecting claw 10*a* to be discharged to the tray 12. The ejecting claw 10*a* is detected in connection with its predetermined position by using a sensor 39.

The paper discharge roller pair 68 is provided with a brush roller that is not illustrated, and back flow of rear end of the paper is prevented by using the brush roller. It should be noted that the beating roller 5 is rotated in the direction of counterclockwise rotation. Up to here, it is outline of configuration and operation of original functional part of the sheet-shaped medium after-treatment apparatus.

The sheet-shaped medium after-treatment apparatus 51 is capable of conducting after-treatment to be the original function, and is capable of arranging to sort the paper after being piled on the tray 12 depending on function of the sheet-shaped medium processing apparatus. Processing of arrangement and sorting of the paper S in the conveyance route on and after the paper discharge roller 3 is conducted by using the sheet-shaped medium processing apparatus integrated with the sheet-shaped medium after-treatment apparatus 51.

In FIG. 1, the sheet-shaped medium processing apparatus is provided with the paper discharge roller 3, the tray 12 for piling the paper S discharged from the paper discharge roller 3, a lifting means of the tray for elevating the tray 12, positioning means for controlling position of elevation direction of the tray 12, an arranging means of having arranging function for arranging the piled paper on the tray 12 while being discharged from the paper discharge roller 3 only at the fixed position in the shift direction "c" in conjunction with sorting/arranging function for sorting at the different position in the shift direction in every sheaf.

The arranging means is illustrated in FIG. 1 while adding reference numeral 100, in which the arranging means comprises arranging members 102*a* and 102*b*, and an arranging member driving device 99 for operating the arranging members, further, each detail will be described later. The lifting means of the tray is illustrated in FIG. 2(*a*) with reference numeral 95 added, and the positioning means in the elevation direction is illustrated in FIG. 2(*a*) and FIG. 2(*b*) with reference numeral 96 added.

[2]-2: Tray

In FIG. 1, in cases where arrangement mode (③), sorting/arranging mode (④) are instructed, the paper S is conveyed toward the tray 12 via the discharged paper sensor 38 from the branch claw 8*b* by using the conveyance roller pair 2*b* to be conveyance means of the paper, then the paper S is sent in the discharge direction "a" by using the paper discharge roller 3.

Figure 2:
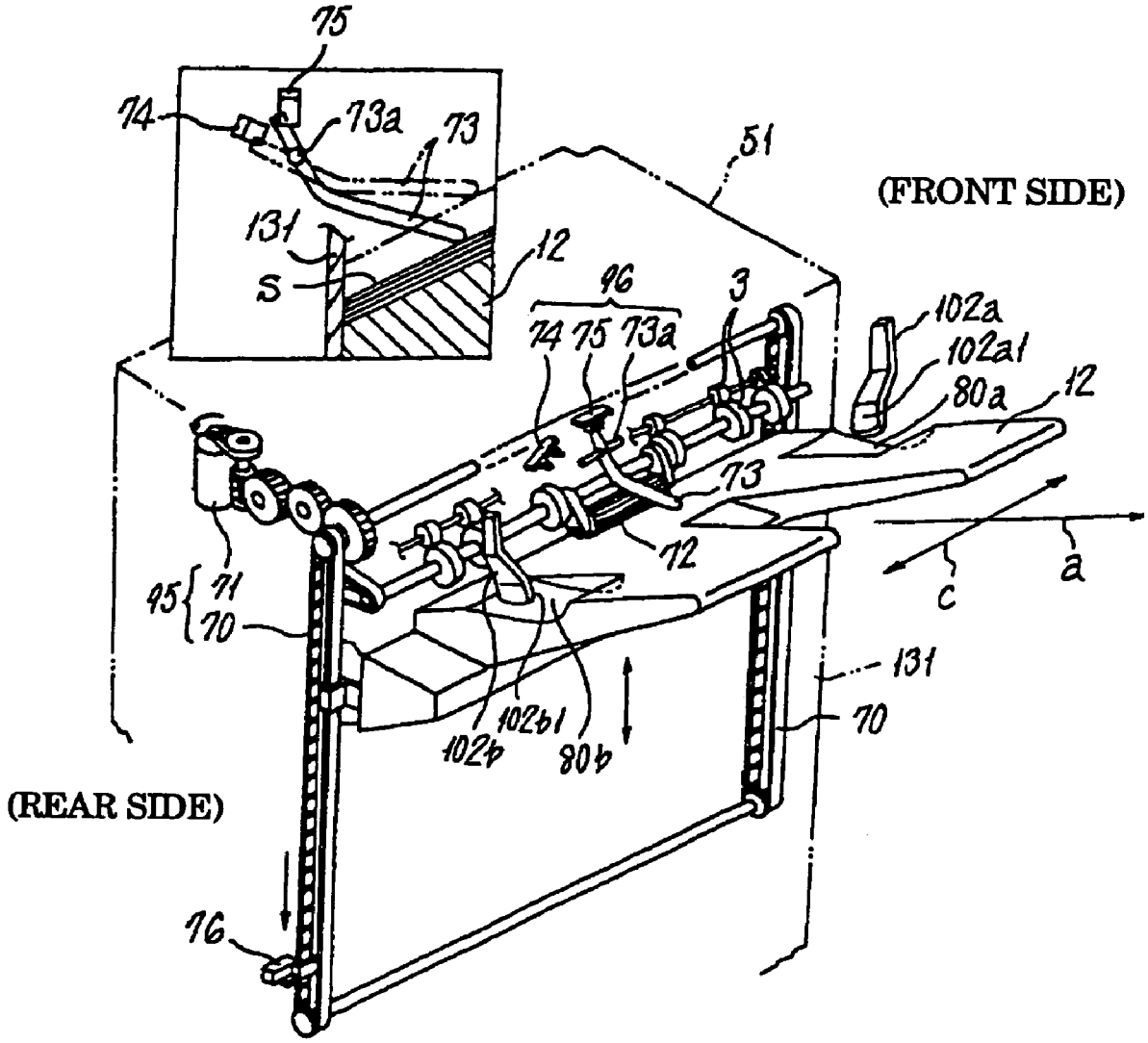
FIG. 2(*a*) is a principal portion perspective view of the sheet-shaped medium after-treatment apparatus.
Figure 2:
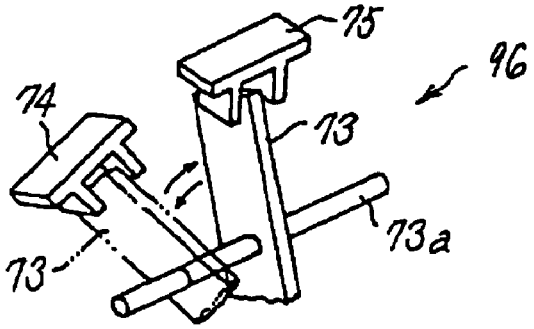

As illustrated in FIG. 1, and FIG. 2(*a*), upper surface of the tray 12 tapers, in which the more proceeding in the discharge direction "a", the more height of the upper surface increases. The end fence 131 is located at lower rear anchor section of slanted surface of the tray 12.

Figure 3:
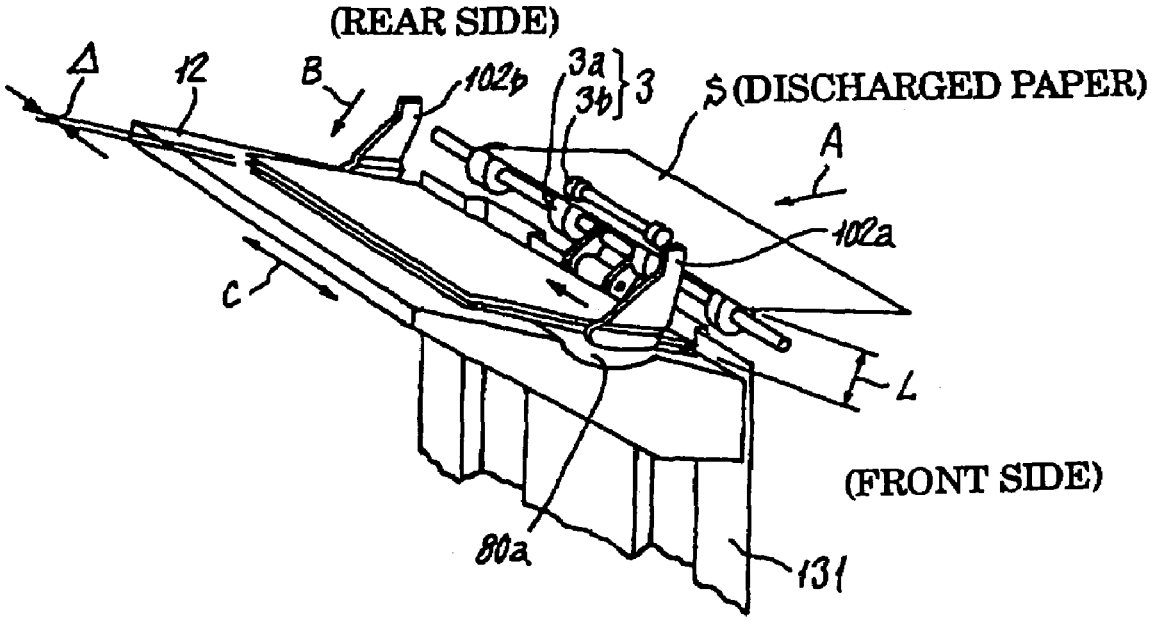
FIG. 3 is a perspective view of circumference of the tray of piling the papers.

In FIG. 1 and FIG. 3, the paper S discharged from the paper discharge roller 3 goes into between the arranging members 102*a* and 102*b* of being waited at the predetermined wait position (hereinafter referred to as acceptance position) apart from width of the paper S, then the paper S slides along the slanted surface on the tray 12 depending on the force of gravity, and rear end section of the paper S is arranged to be straightened in such a way that the rear end section of the paper S is struck to the end fence 131. The paper S whose rear end section is straightened, piled on the tray 12 is sorted to be arranged only at the fixed position in the shift direction "c" or is sorted to be arranged at the different position in the shift direction "c" in every sheaf due to arranging operation of the arranging members 102*a* and 102*b*.

As illustrated in FIG. 2(*a*), a concave section 80*a* is formed at part of being opposed to the arranging member 102*a* and a concave section 80*b* is formed at part of being opposed to the arranging member 102*b*, thus lower depression than upper surface of the tray 12 is formed partially. At least, in the condition that the paper is not piled on these concave sections 80*a* and 80*b*, the arranging members 102*a* and 102*b* located at the acceptance position, whose parts enter in these concave sections 80*a* and 80*b*, hold the conditions of overlapping with the tray 12. For that reason, it is possible to strike the arranging members 102*a* and 102*b* to end face of the paper S certainly in the arranging operation.

[2]-3: Lifting Means of Tray, Positioning Means in Elevation Direction

A lifting means 95 for elevating the tray 12 will be made to explain by using FIG. 2(*a*), and a positioning means 96 of the tray will be made to explain by using FIG. 2(*a*) and FIG. 2(*b*). The positioning means of the tray, at the time of discharging the paper S from the paper discharge roller 3, determines position of the tray 12 in the elevation direction depending on the lifting means 95 so that position in the direction of up-and-down of the upper surface of the tray 12 or the top surface of the paper piled on the upper surface of the tray 12 becomes appropriate discharge position of being better suited for discharge of the paper S from the paper discharge roller 3.

In FIG. 1, and FIG. 2(*a*), the paper discharge roller 3 is located at fixed position. Consequently, supposing that constitution is one in which the tray 12 does not move up and down, when the paper S is discharged and piled on the tray 12, height of piled large number of papers is elevated, so that these piled paper obstruct discharge of the paper, thus it becomes impossible to discharge the paper S lastly.

The tray 12 can be made to move up and down by providing the lifting means, and it is possible to maintain intervals from nip section of the paper discharge roller 3 to upper surface of the tray 12 or intervals from nip section of the paper discharge roller 3 to the top surface of piled large number of papers on the tray 12 into correct intervals of being conducted correct discharge of the paper by using the positioning means. For that reason, it is possible to discharge the paper S in such a condition that fluctuation of landing position on upper surface of the tray 12 is small.

As illustrated in FIG. 2(*a*), the tray 12 is hanged by using an up-and-down lift belt 70. The up-and-down lift belt 70 is driven by an up-and-down motor 71 through gear train and timing belt, and goes up or comes down depending on normal rotation or reverse rotation of the up-and-down motor 71. These up-and-down lift belt 70, up-and-down motor 71, gear train and timing belt and so forth are principal configuration elements of the lifting means 95 of moving up-and-down the tray.

In FIG. 2(*a*), the return roller 72 made of sponge shaped material comes into contact with piling surface of the tray 12 with own weight in such a condition that the return roller 72 is capable of being oscillated. The paper S sent out on the tray 12 slides off along inclined plane of the tray 12, at the time the return roller 72 has a nip at rear end side of the paper S, the paper S heads over to downward direction while being fed by using the return roller 72 to be struck to the end fence 131 as paper receiving means, and its lengthwise direction (paper feeding direction) is straightened.

Thus, the paper S after image formation is discharged to be piled continuously on the tray 12, whereby the top surface of the paper S goes up in upward direction. As illustrated in FIG. 2(*a*), a paper surface lever 73 is provided at the top surface of the piled paper so that one end side of the paper surface lever 73 of being supported by a shaft 73*a* with swinging free comes into contact with the top surface of the paper by gravity. Another end side of the paper surface lever 73 is detected by a paper surface sensor 74 constituted by photo interrupter.

The paper surface sensor 74 controls up-and-down position of the tray 12 so that landing height from the paper discharge roller 3 becomes constant, and a paper surface sensor 75 conducts the same control in the staple mode, in which discharge position of the paper can be made to set free in up-and-down direction depending on the mode.

The paper surface lever 73 rotates depending on momentum of own weight with fulcrum as the center, and there is provided a stopper means so as to stop rotation of the paper surface lever 73 at position that free end section of upper side of the paper surface lever 73 turns ON the paper surface sensor 75 or the paper surface sensor 74 as the tray 12 comes down in downward direction.

The stopper means, in the sorting processing, stops the rotation of the paper surface lever 73 at the position where the paper surface lever 73 causes the paper surface sensor 74 to be turned ON, while in the staple mode, stops the rotation of the paper surface lever 73 at the position where the paper surface lever 73 causes the paper surface sensor 75 to be turned ON. When the paper S is piled continuously on the tray 12, free end section of downside of the paper surface lever 73 is pushed up. In addition, the paper surface lever 73 departs from the paper surface sensor 75 or the paper surface sensor 74 according to the conditions, then these sensors turn OFF.

Here, since the mode is one in which the arranging mode or the sorting/arranging mode, control is made that piled surface of the paper S goes up in upward direction in every time that the paper S is discharged one by one, and the tray 12 is made to come down in downward direction until the paper surface sensor 74 turns ON with the up-and-down motor 71 driven in every time that the free end section of the paper surface lever 73 departs from the paper surface sensor 74. For that reason, condition of landing position of the paper S on the tray 12 is one in which intervals between the paper discharge roller 3 and the tray 12 (the top surface of the paper) is controlled into the correct intervals. Here, the paper surface sensors 74 and 75, and the paper surface lever 73 and so forth are the principal configuration elements of the positioning means 96 of the tray for controlling height of the tray 12 into constant height, thus the positioning means 96 detects information for positioning to send to a control means.

Height position of the tray 12 under such correct intervals is called as correct discharge position, which is the position of being set as appropriate position of receiving paper with normal condition except for the papers of being sent out with particular aspect such curled condition and so forth.

It is not surprising that correct discharge position of the tray 12 is different between the case that the paper is discharged one by one at the sorting mode and the case that the paper sheaf of being subjected to staple processing is discharged at the staple mode because conditions of paper discharge are different. As is clear from the fact that the position is made to be different between the paper surface sensor 75 and the paper surface sensor 74.

Even though the mode is one that is related to any after-treatment of the sorting mode and the staple mode, the paper S from the paper discharge roller 3 is discharged on the tray 12 at the reference height of being suited to respective cases, and the tray 12 descends in every time the paper S piles up, ultimately lower limit position is detected by a lower limit sensor 76. In addition, at the time the tray 12 goes up, the tray 12 is lifted up to the reference height on the basis of detected information of the paper obtained from the positioning means such as the paper surface sensors 74, and 75, the paper surface lever 73 and so forth.

The return roller 72 is one in which the return roller 72 swings free with the fulcrum shaft as the center, when the tray 12 arrives at predetermined rise limit position, a swing end section pushes upper limit switch of the tray 12 to stop the up-and-down motor 71, so that breakage of the tray 12 caused by over run is prevented. The tray 12, at the time of discharging the paper, is controlled at the correct discharge position under the correct intervals by using the lifting means 95 and the positioning means 96.

[2]-4: Arranging Means (a. Arranging Member)

As illustrated in FIG. 2(*a*), and FIG. 3, one pair of arranging members 102*a*, 102*b* are composed of board shaped body, and arranging sections 102*a*1, 102*b*1 are located at the bottom section of these arranging members 102*a*, 102*b*, opposite surfaces are planar surfaces at right angles to the shift direction "c".

Thus, the arranging sections 102*a*1, 102*b*1 are ones in which opposite surfaces are planar surfaces at right angles to the shift direction "c", whereby it is possible to arrange the paper sheaf while parting and contacting the arranging sections 102*a*1, 102*b*1 to end surface of the paper S piled on the tray 12 in such a way as to move the arranging members 102, 103 in the shift direction "c". In addition, because of board shaped body, it becomes compact configuration.

As described later in line with FIG. 17, when the arranging members 102*a*, 102*b* conduct the paper S discharged from the paper discharge roller 3 illustrated in FIG. 1 and FIG. 2 within opposite intervals of these arranging members 102*a*, 102*b*, in order to avoid interference of the discharged paper therebetween, upward sections of respective arranging sections 102*a*1, 102*b*1 form step shaped relief sections 102*a*2, 102*b*2 with wider intervals than the opposite intervals of the arranging sections 102*a*1, 102*b*1.

(b. Outline of Operation by Using Arranging Member)

Outline of sorting, arranging operation by using the arranging members 102*a*, 102*b* will be described. In FIG. 1, FIG. 2 and FIG. 3, the tray 12 is gone up and down by using the tray lifting means 95 and is always controlled at the position of being suited for landing of the paper S by using the positioning means 96. The arranging members 102*a*, 102*b* wait, on the occasion of arrangement or sorting/arranging, at related position of being opposite on the shift direction "c" by using the arranging member driving device 99, namely, at the acceptance position of taking predetermined opposite intervals capable of being received the paper S discharged from the paper discharge roller 3.

At least, one of the arranging members 102*a*, 102*b* comes into contact with end face of the paper S in the degree of pressing slightly while conducting operation of narrowing down the opposite intervals from the acceptance position so as to put the paper therebetween, after that, the arranging members conduct operation of broadening the opposite intervals to come back at the acceptance position in every time that the paper S is discharged from the paper discharge roller 3 before the paper S is piled on the tray 12. The end face of the paper are arranged in such a way as to conduct a series of arranging operation.

In the time of functioning shift arrangement, after the time that the predetermined number of the paper S of configuring one copy (hereinafter referred to as only a copy) to be an unit of sorting specified beforehand are discharged to be arranged, the arranging members 102*a*, 102*b* move to evacuate to evacuation position apart from the paper sheaf in order to avoid interference to the paper sheaf of copies after arranging, followed by moving in the shift direction "c" only predetermined shift amount with evacuation condition kept, after that, the arranging members 102*a*, 102*b* are restored to the condition of being capable of arranging the paper from the evacuation position, before waiting at the acceptance position of securing intervals capable of being received the papers, thus the arranging members 102*a*, 102*b* arrange the piled papers so as to operate arranging member of the reverse side to the arranging member of operating previously in every time that the paper is discharged to be piled in the same way as described above. It is possible to conduct sorting/arranging of the paper so as to repeat this action.

It should be noted that, in the above description, if only arranging action is made to repeat at the fixed position on the shift direction "c" without movement of the shift amount, arranging function is achieved, while sorting/arranging function is achieved in such a way that arranging action of the paper is made to repeat while conducting movement action in the shift direction "c" in every completion of the copies.

During the arranging action for the arranging function, or during the sorting/arranging action for the sorting/arranging function, the papers S are piled on the tray 12 continuously, whereby, the tray 12 is controlled so that the position of the top surface of the paper maintains constant height from the nip section of the paper discharge roller 3 while causing the tray 12 to descend only appropriate amount by using the lifting means 95 of the tray and the positioning means 96 in up-and-down direction of the tray and the landing position of the paper is maintained into the constant level. Above is outline of configuration and operation in the sheet-shaped medium processing apparatus.

(c. Arranging Member Driving Device)

Upper end section of the arranging members 102*a*, 102*b* illustrated in FIG. 1, FIG. 2(*a*), FIG. 3 and so forth is installed on the arranging member drive device 99 illustrated in FIG. 1. The arranging member drive device 99 is constituted together with a frame 90. There are provided a moving means of the arranging member, an evacuating means of the arranging member, an arranging member operating device and so forth, all of which will be explained later, as means of conducting arranging action of the arranging members 102*a*, 102*b* and means of conducting another action should be operated accompanying the arranging action at the frame 90, and these respective means are controlled by using a control means consisting of the microcomputer. The control means is one in which the sheet-shaped medium after-treatment apparatus 51 illustrated in FIG. 1 shares this control means, and the control means is connected to an arranging means 100 via input/output line that is not illustrated.

Figure 4:
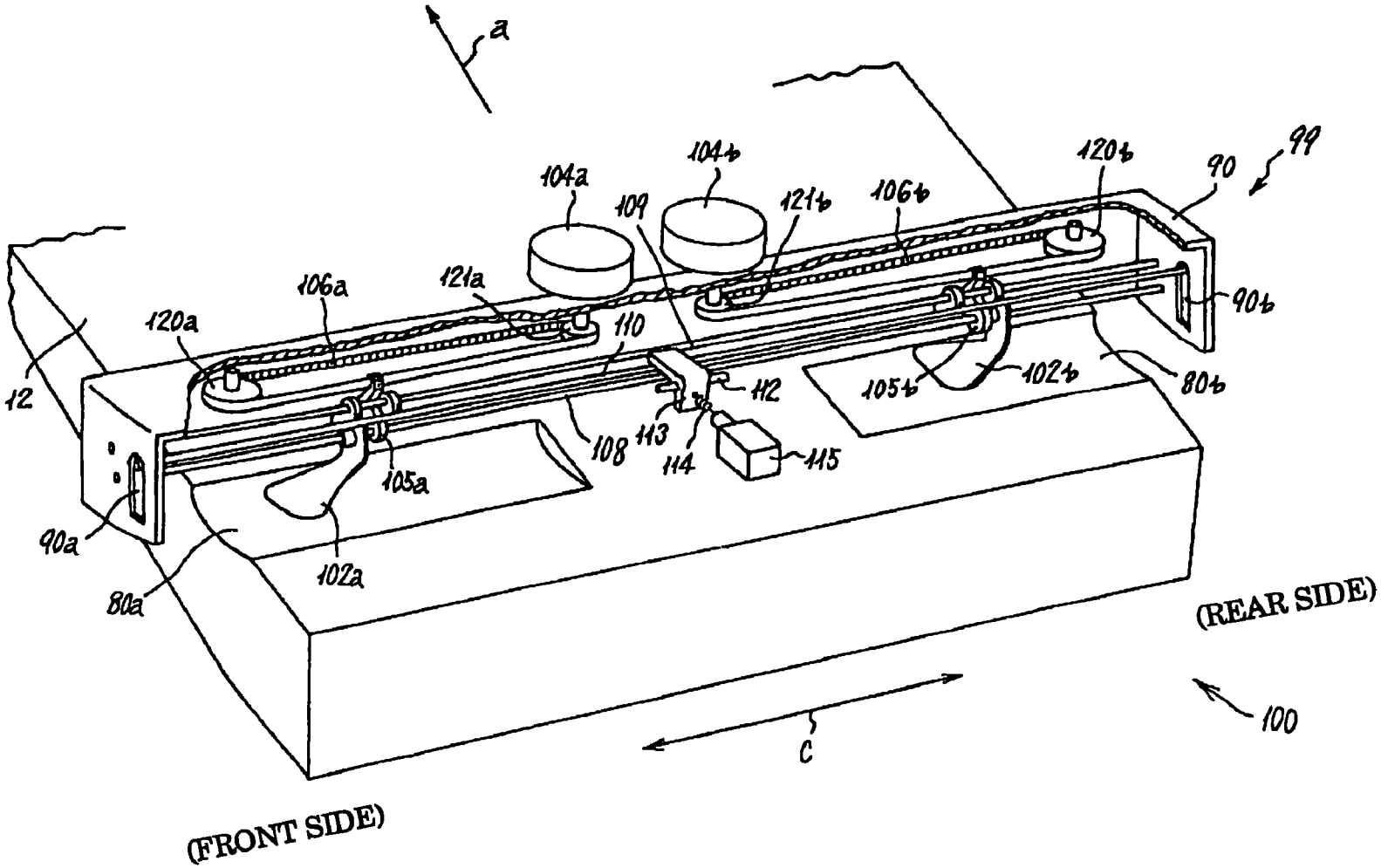
FIG. 4 is a perspective view of arranging means.

As illustrated in FIG. 4, mechanical component part of the arranging member driving device 99 is constituted as an integral unit while being accommodated within the box-shaped frame 90. In FIG. 1, the frame 90 is screwed on body of the sheet-shaped medium after-treatment apparatus 51, or is mounted on the body detachably by using a concave/convex shaped mounting means, accordingly, it is possible to cope with easily the user who requires no arranging function by using the arranging means 100. Here, since the arranging members 102*a*, 102*b* are supported within the frame 90, the arranging means 100 is supported by the sheet-shaped medium after-treatment apparatus 51 upper than the paper discharge roller 3.

Thus, since constitution is one in which supporting part of the arranging members 102*a*, 102*b* is supported by the body of the sheet-shaped medium after-treatment apparatus 51 at upward direction of the paper discharge roller 3, it is possible to operate the arranging members 102*a*, 102*b* without influencing up-and-down movement of the tray 12 and discharge action of the paper S from the paper discharge roller 3, thus it is possible to constitute the arranging members 102*a*, 102*b*.

c-1. Moving Means of Arranging Member

The arranging members 102*a*, 102*b*, on the occasion of arranging action, are located at home position of widening its interval before being located at the acceptance position of accepting the paper discharged from the paper discharge roller 3 on the shift direction "c", then, move to the acceptance position from the home position to conduct arranging action, further when achieving sorting/arranging function, move in the shift direction, thus conduct movement in the shift direction "c".

In order to permit movement in such a shift direction "c", the arranging means 100 is provided with a moving means of the arranging member. Explanation will be made about the moving means of the arranging member.

The moving means of the arranging member, in the case of one side movement aspect of achieving sorting/arranging function, role in which one of the arranging members 102*a*, 102*b* becomes immobility and the other becomes movement alternates with role in which one of the arranging members 102*a*, 102*b* becomes movement and the other becomes immobility in every time that the tray 12 shifts. In the case of only arranging function, both side movement aspect can be adopted, in this case, both of the arranging members 102*a*, 102*b* are made to conduct action of approximating to the paper or to conduct action of estranging from the paper at the fixed position in the shift direction "c" in every discharge and piling of the paper.

In FIG. 4, when the tray 12 is made to see from upstream of the discharge direction "a" toward downstream thereof, supposing that left side on the shift direction "c" is taken to be front side, and right side is taken to be rear side, the arranging member 102*a* is the front side arranging member, and the arranging member 102*b* is the rear side arranging member.

Figure 6:
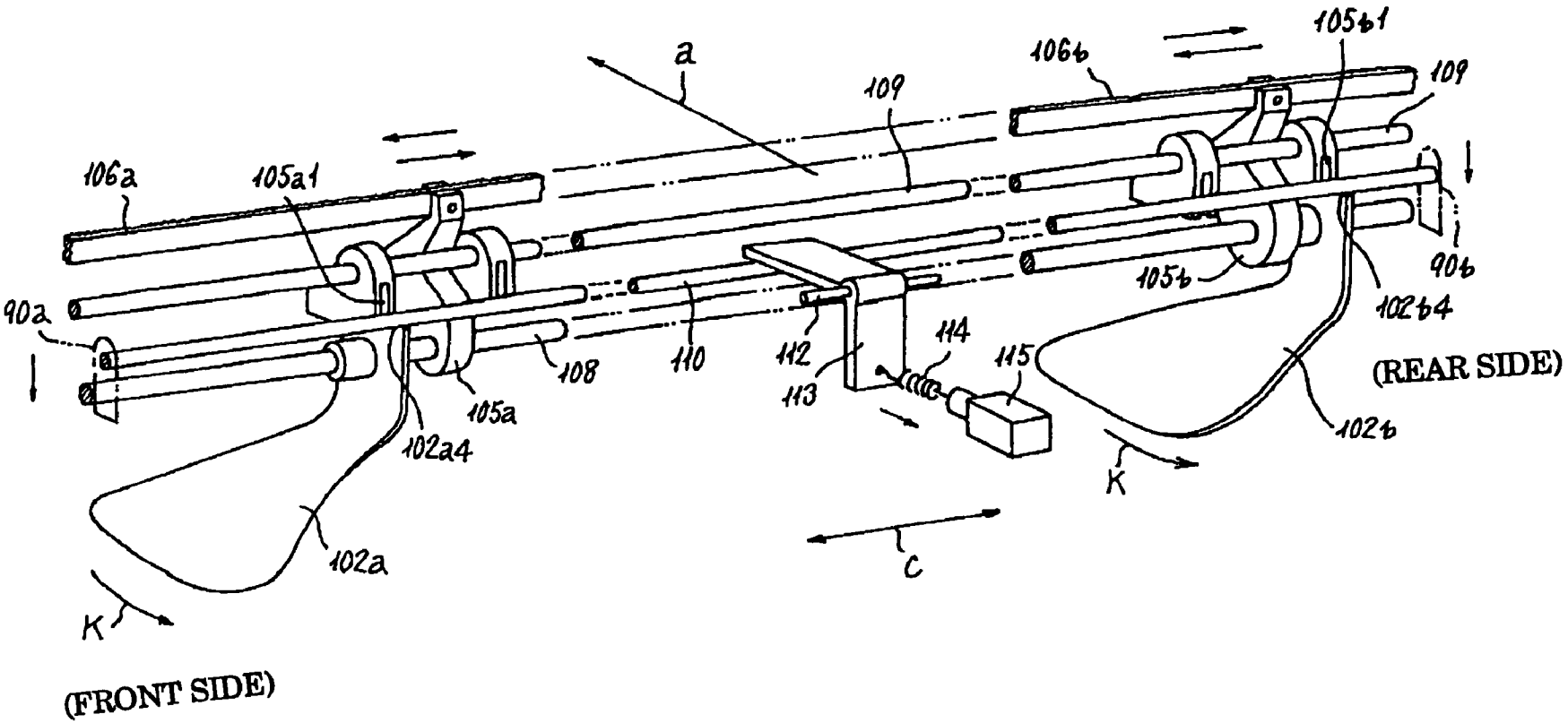
FIG. 6 is a perspective view illustrating principal portion of a driving mechanism of the arranging member.

In FIG. 4 and FIG. 6, the arranging member 102*a* is engaged with a column-shaped shaft 108 in parallel with the shift direction "c", with sliding free. Both end sections of the shaft 108 are fixed to the frame 90.

Figure 7:
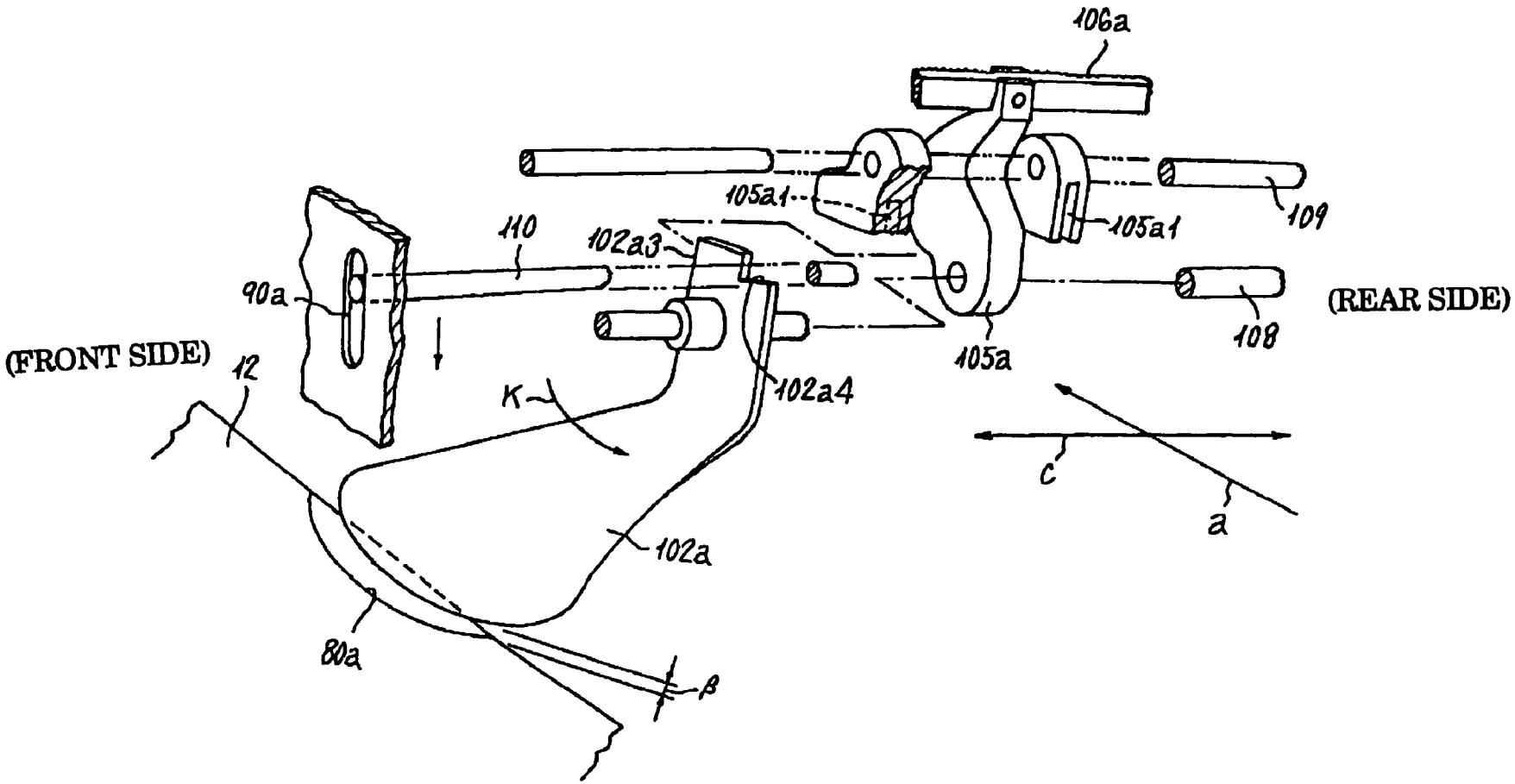
FIG. 7 is a perspective view illustrating principal portion of a driving mechanism of the arranging member.

As illustrated in FIG. 6 and FIG. 7, upper end section of the arranging member 102*a* is recessed in a slit 105*a*1 in parallel with flat surface at right angles to the shaft 108 formed at a receiving pedestal 105*a*. The receiving pedestal 105*a* is fitted on the shaft 108 with sliding free, and also is fitted on a guide shaft 109 in parallel with the shaft 108. Further, upper portion of the receiving pedestal 105*a* is fixed to a timing belt 106*a*.

As illustrated in FIG. 4, FIG. 9 to FIG. 13, and FIG. 16, the timing belt 106*a* is stretched between a pulley 120*a* and a pulley 121*a*. The pulley 120*a* is fitted to be supported on shaft fixed to the frame 90. The pulley 121*a* is fixed to rotary shaft of a stepping motor 104*a* fixed to the frame 90.

These the stepping motor 104*a*, the receiving pedestal 105*a*, the timing belt 106*a*, the shaft 108, and the guide shaft 109 are principal members for constituting the moving means of the arranging member 102*a*.

The moving means for the arranging member 102*b* of the rear side will be explained.

As illustrated in FIG. 6 and FIG. 7, the arranging member 102*b* is engaged with the same shaft as that of the arranging member 102*a* with sliding free. In addition, the arranging member 102*b* is recessed in a slit 105*b*1 of a receiving pedestal 105*b* in the same way as engagement relationship between the arranging member 102*a* and the receiving pedestal 105*a*.

Upper portion of the receiving pedestal 105*b* is fixed to a timing belt 106*b*. As illustrated in FIG. 4, FIG. 9 to FIG. 13, and FIG. 16, the timing belt 106*b* is stretched between a pulley 120*b* and a pulley 121*b*. The pulley 120*b* is fitted to be supported on shaft fixed to the frame 90. The pulley 121*b* is fixed to rotary shaft of a stepping motor 104*b* fixed to the frame 90.

These the stepping motor 104*b*, the receiving pedestal 105*b*, the timing belt 106*b*, the shaft 108, and the guide shaft 109 are principal members for constituting the moving means of the arranging member 102*b*.

In the present example, the shaft 108 and the guide shaft 109 share functions of guiding and of supporting stably the receiving pedestals 105*a* and 105*b*, however, area of being used on the occasion of movement of the arranging members 102*a* and 102*b* is shifted between the front side and the rear side, therefore, the shaft 108 and the guide shaft 109 are provided independently.

Thus, the arranging members 102*a* and 102*b* are provided with each independent moving means, whereby, the timing belts 106*a* and 106*b* rotate independently in such a way that the stepping motors 104*a* and 104*b* made to conduct switching drive of normal rotation and reverse rotation independently, at the same time the receiving pedestals 105*a* and 105*b* move accompanying with movement of the timing belts, thus the arranging members 102*a* and 102*b* that are put between the slits 105*a*1 and 105*b*1 formed at the receiving pedestals 105*a* and 105*b* move in the shift direction "c" independently.

About respective arranging members 102*a*, 102*b*, by using the moving means of the arranging member with such configuration, it is possible to drive the arranging members 102*a* and 102*b* independently. For instance, in cases where arranging action is made at the one side movement aspect, at arbitrary job, the arranging member 102*b* is made to move to be arranged the paper with the arranging member 102*a* not moved, and at next job, the arranging member 102*a* is made to move to be arranged the paper with the arranging member 102*b* not moved, thus it is possible to conduct sorting/arranging action while exchanging alternately the role of moving side and not moving side from between respective arranging members 102*a* and 102*b*. In this case, one side of the arranging member is not moved, whereby, operating time is reduced and it is possible to minimize sound, exhaustion degree of the member is small. It should be noted that, it is possible to adopt the both side movement aspect of moving both arranging members 102*a* and 102*b* in the arranging action.

c-2: Position Control of Arranging Member

In FIG. 6 and FIG. 7, the shaft 108 is a guide for guiding the arranging member 102*a* in the shift direction "c", and is also a supporting shaft for supporting the arranging member 102*a* rotatably. Upper end section of the arranging member 102*a* is recessed within the slit 105*a*1 as described above, and lower end side of the arranging member 102*a* is extending toward the side of the discharge direction "a" from the shaft 108. For that reason, center of gravity position of the arranging member 102*a* is shifted in the discharge direction "a", whereby, the arranging member 102*a* receives moment of arrow K direction depending on own weight with the shaft 108 as the center.

Figure 8:
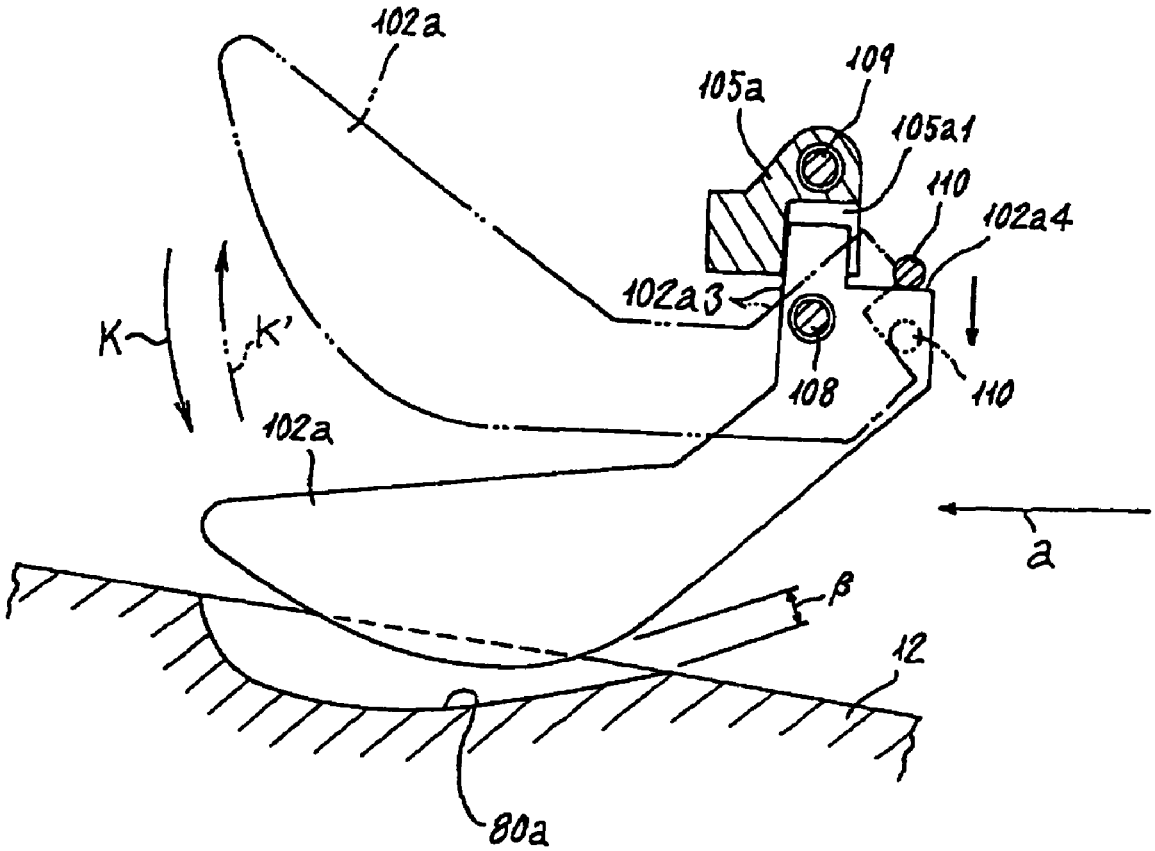
FIG. 8 is an elevation view for explaining evacuation position and arrangement operation position of the arranging member.

As illustrated in FIG. 7 and FIG. 8, inner part of the slit 105*a*1 is not opened, and is closed up. For that reason, rotation of the arranging member 102*a* due to moment in the direction of arrow K is contained in such a way that an upper end edge section 102*a*3 of the arranging member 102*a* comes into contact with the inner part of the slit 105*a*1 unless interference of the paper S on the tray 12 therebetween does not occur. In FIG. 8, the arranging member 102*a* under the condition of being avoided of the rotation is illustrated by using solid line.

Since the slit 105*a*1 is formed on the receiving pedestal 105*a*, the receiving pedestal 105*a* is also regulating member for regulating rotation amount with the shaft 108 as the center of the arranging member 102*a*. The completely same configuration and operation are effected between the arranging member 102*b* and the receiving pedestal 105*b*.

It is not necessary to provide special positioning mechanism in the rotational direction because constant position on the rotational direction is maintained automatically while being regulated rotation depending on moment of own weight of one pair of arranging members 102*a*, 102*b* due to function of regulating member regarding rotation amount by the receiving pedestal 105*a* and the receiving pedestal 105*b* of having the slit 105*a*1 and the slit 105*b*1 whose inner parts are closed up.

Figure 5:
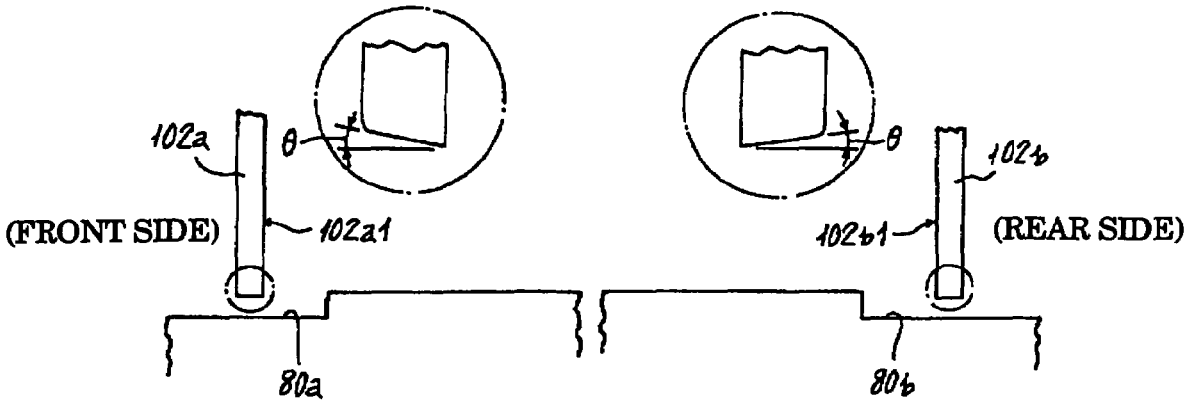
FIG. 5 is a view for explaining an edge within lower end section of an arranging member.

As illustrated in FIG. 4, FIG. 5, and FIG. 7, at least, in the condition that the papers are not piled on these concave sections 80*a* and 80*b*, these arranging members 102*a*, 102*b* are engaged to be stopped by the inner parts of the slits 105*a*1, 105*b*1 at the condition that respective lower end sections of the arranging members 102*a*, 102*b* are located at downward reaches from the piling surface of the tray 12, namely, the respective lower end sections of the arranging members 102*a*, 102*b* are set to be located within the concave sections 80*a*, 80*b*.

Figure 10:
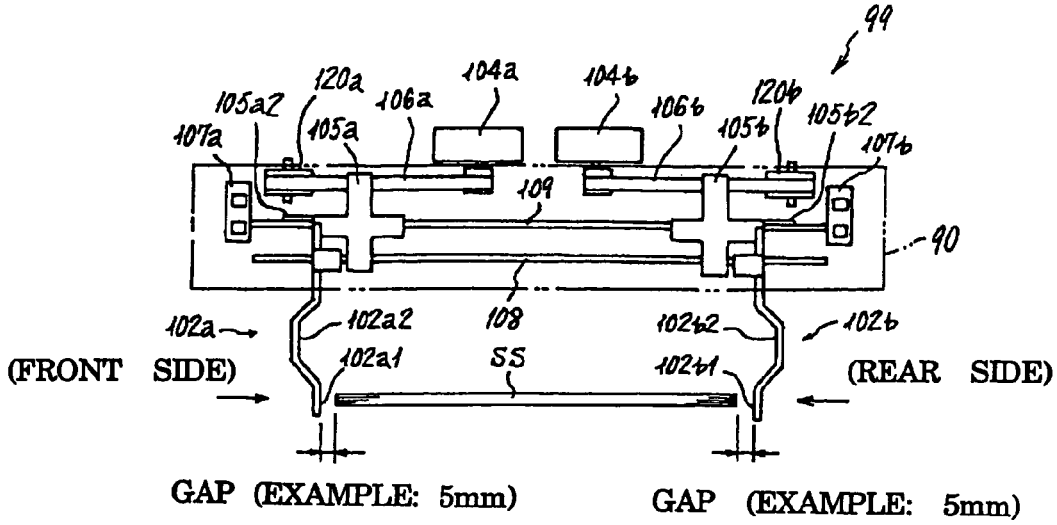
FIG. 10 is an outline elevation view of the arranging member of being located at the acceptance position as seen from the side of the paper discharge roller.
Figure 12:
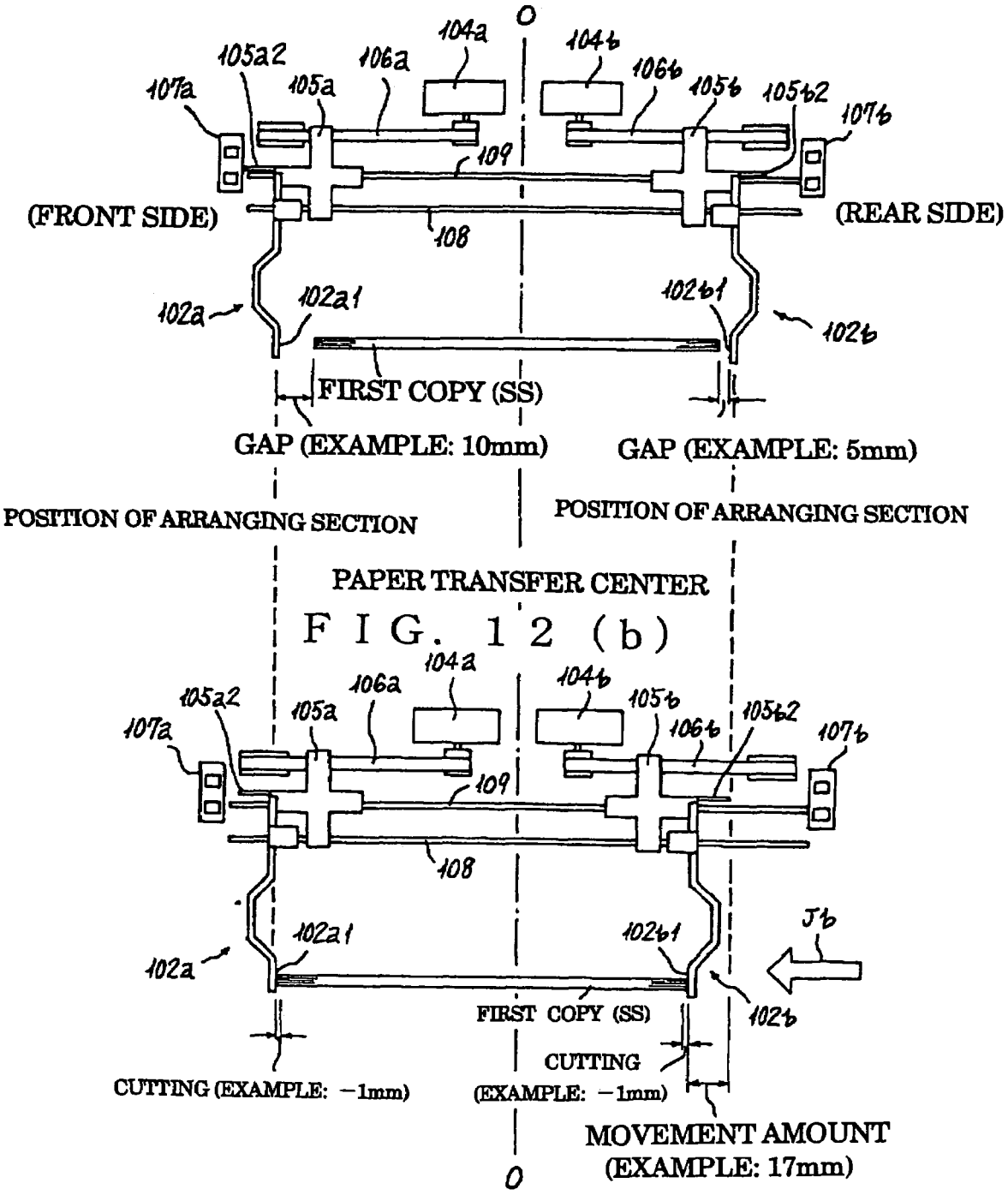
FIG. 12(*a*) is an outline elevation view of the arranging member of being located at the acceptance position at the time of sorting/arranging as seen from the side of the paper discharge roller.

As illustrated in FIG. 10, FIG. 12(*a*), when the arranging members 102*a*, 102*b* are located at the acceptance position on the shift direction "c", the arranging members 102*a*, 102*b* are located within the concave sections 80*a*, 80*b* due to moment depending on own weight while putting the paper of being piled condition with the paper discharged therebetween.

Figure 13:
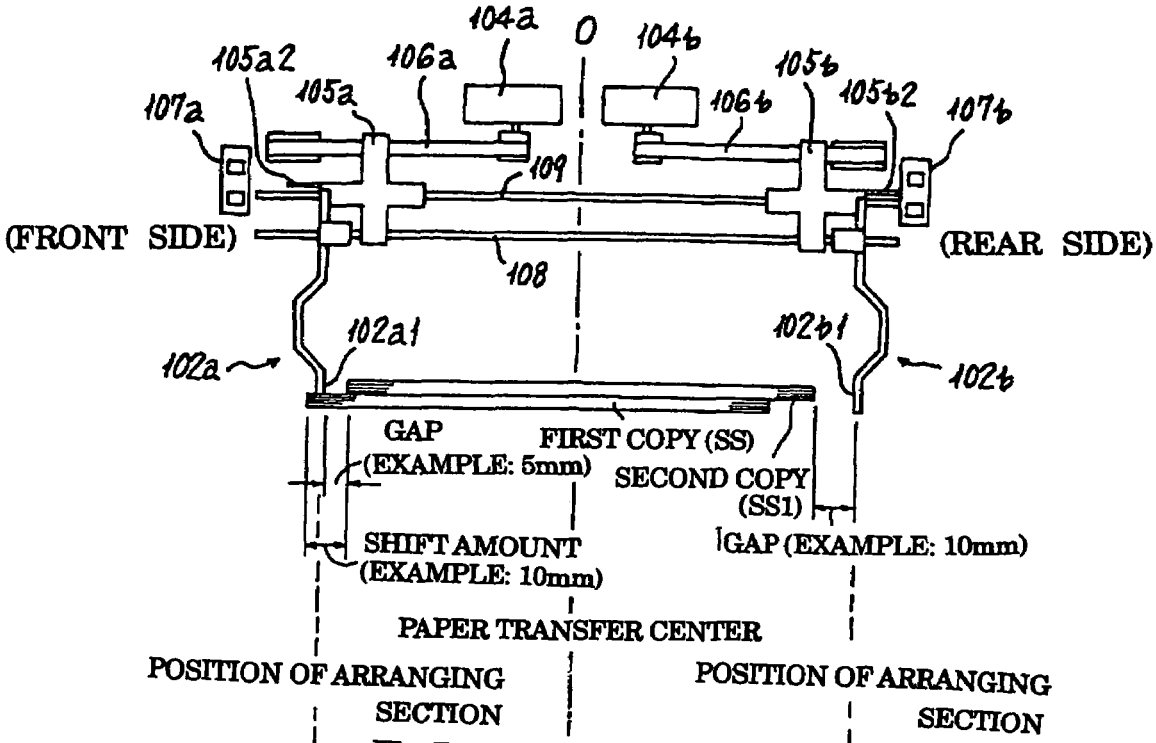
FIG. 13(*a*) is an outline elevation view of the arranging member of being located at the acceptance position at the time of sorting/arranging as seen from the side of the paper discharge roller.
Figure 13:
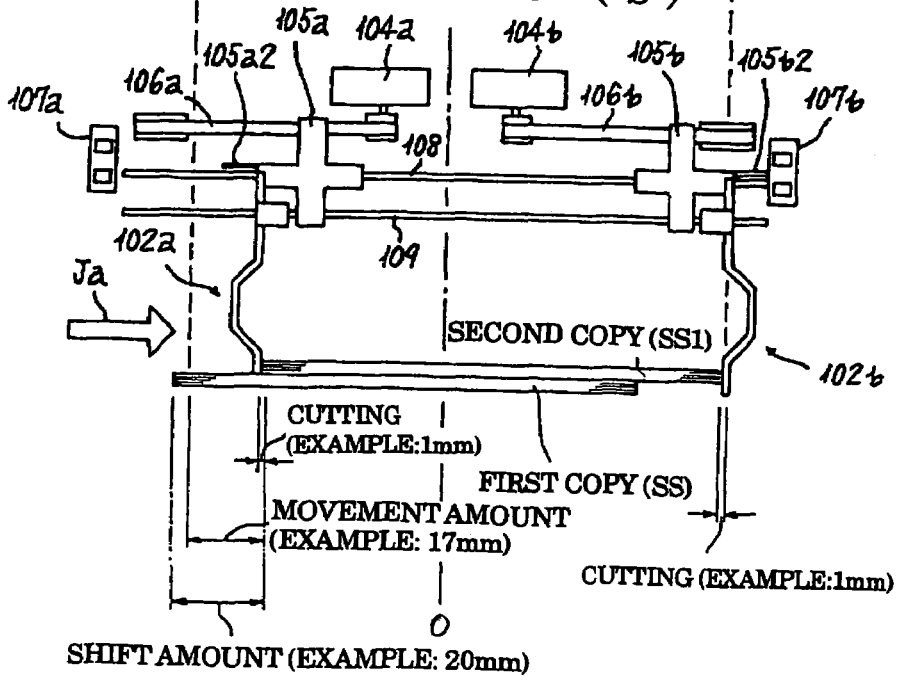

At this time, as illustrated in FIG. 6, FIG. 8 (solid line), the upper end edge section 102*a*3 is engaged to be stopped by the inner parts of the slits 105*a*1, 105*b*1. Thus, rotation in the direction of arrow K is avoided, however, rotation of reverse direction of arrow K is not avoided. Consequently, when the paper S is piled on the tray 12 so as to block up the concave sections 80*a*, 80*b*, as illustrated in FIG. 13(*a*), FIG. 13(*b*), and FIG. 16, the arranging member 102*a* (or 102*b*) comes into contact with the paper S on the tray 12 depending on the own weight.

As described above, if there is no paper on the tray 12, lower end section of the arranging members 102*a*, 102*b* are located within the concave sections 80*a*, 80*b*, if there is a paper on the tray 12, the lower end section of the arranging members 102*a*, 102*b* come into contact with the top surface of the paper. Regardless of these every conditions, it is possible to move to shift arranging action depending on movement of the shift direction "c".

Thus, the arranging members 102*a*, 102*b*, if the papers are located on the concave sections 80*a*, 80*b* of the tray 12, maintain its position depending on the own weight on the top surface of these papers, while if the papers are not located on the concave sections 80*a*, 80*b*, the arranging members 102*a*, 102*b* occupy positions within concave sections, however, the arranging members 102*a*, 102*b* do not influence the concave sections.

In cases where the arranging members 102*a*, 102*b* are placed at arrangement operation position within the concave sections 80*a*, 80*b* on the rotational direction with the shaft 108 as the center and at the acceptance position of FIG. 10, FIG. 12(*a*) on the shift direction "c", under such conditions, the papers S are piled on the tray 12 between the arranging members 102*a*, 102*b*, it is possible to arrange the papers piled on the tray 12 in such a way as to conduct arranging action while moving any one of the arranging members 102*a*, 102*b*.

In addition, in the case of sorting/arranging, as described later, as illustrated in FIG. 13(*a*), FIG. 13(*b*), the arranging member 102*a* moves in the shift direction with the arranging member 102*a* contacted on the paper S, while in the next copies, on the contrary, the arranging member 102*b* shifts with the arranging member 102*b* contacted on the paper S, however, since it is possible to adjust small the contact pressure to the paper S in such a way as to set appropriately the position of center of gravity of the arranging members 102*a*, 102*b*, accordingly, on the occasion of sorting/arranging action, it is possible to conduct the sorting/arranging action without confusing the paper already arranged.

In FIG. 4 to FIG. 13, shields 105*a*2, 105*b*2 are attached to the receiving pedestals 105*a*, 105*b* respectively, when the stepping motors 104*a*, 104*b* rotate so as to move the receiving pedestals 105*a*, 105*b* in the direction of separating from each other, the shield 105*a*2 of the receiving pedestal 105*a* is inserted in a home position sensor 107*a* to be shielded optically, and the shield 105*b*2 of the receiving pedestal 105*b* is inserted in a home position sensor 107*b* to be shielded optically, whereby, these shielded conditions are detected by the home position sensors 107*a*, 107*b*, on the basis of the detected signals, the stepping motors 104*a*, 104*b* are controlled to be stopped.

Figure 9:
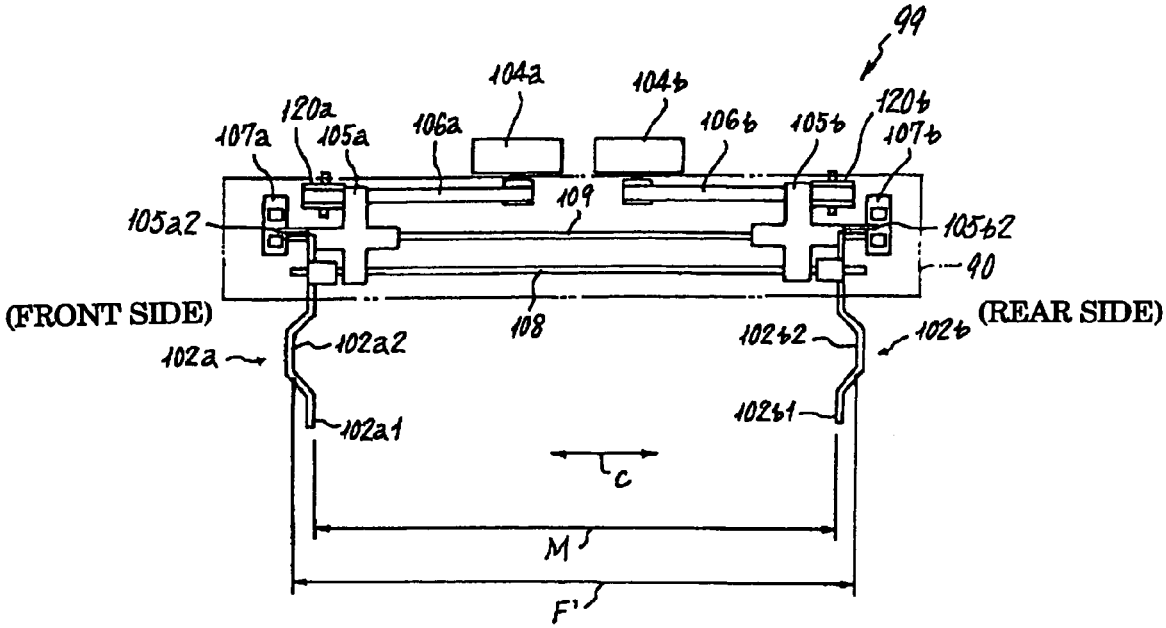
FIG. 9 is an outline elevation view of the arranging member of being located at the home position as seen from the side of paper discharge roller.

Positions of the arranging members 102*a*, 102*b* of being occupied in such a way that the shields 105*a*2, 105*b*2 are detected by the home position sensors 107*a*, 107*b* are home positions of the arranging members 102*a*, 102*b*, wherein the home positions are ones in which intervals of the arranging sections 102*a*1, 102*b*1 of the arranging members 102*a*, 102*b* are wider than the maximum width from among various kinds of sizes of the papers to be object of sorting/arranging and so forth, thus position of opposite intervals M that are wider than the maximum width is illustrated in FIG. 9. The arranging members 102*a*, 102*b* wait at the home positions illustrated in FIG. 9 before entering arranging action or sorting/arranging action.

Figure 11:
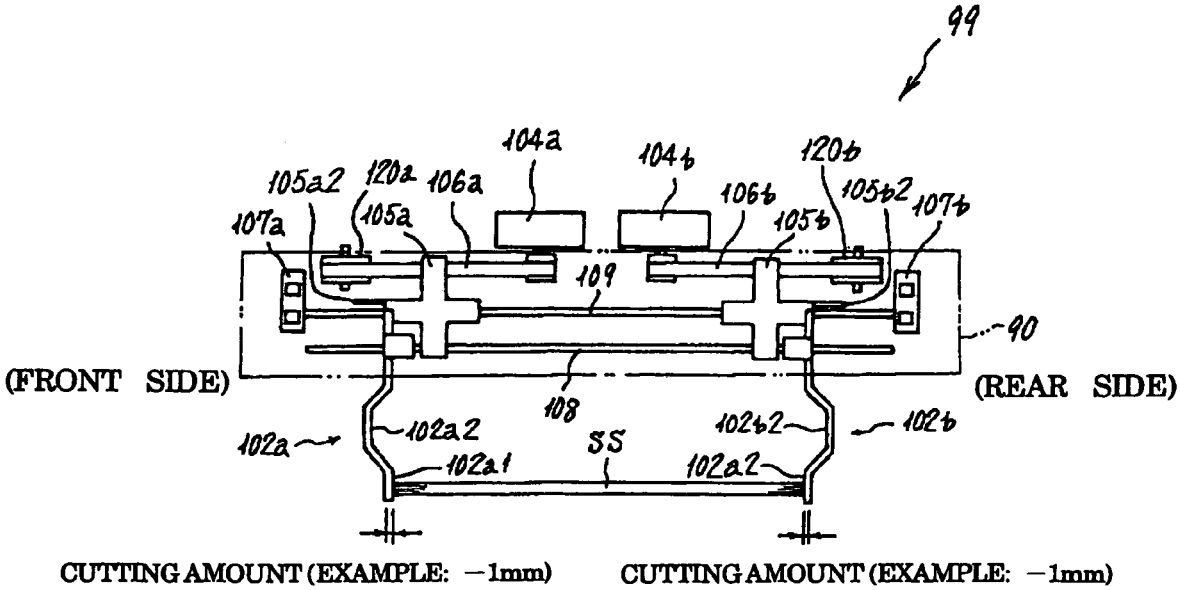
FIG. 11 is an outline elevation view of the arranging member of being located at the arrangement position as seen from the side of the paper discharge roller.

In the case of arranging function of arranging the paper only at the constant position in the shift direction "c", the arranging members 102*a*, 102*b* wait at the acceptance position of being driven in the arrow direction illustrated in FIG. 10 in such a way that the stepping motors 104*a*, 104*b* are driven only predetermined corresponding pulses from respective home positions illustrated in FIG. 9 depending on paper width of the paper S discharged from the paper discharge roller 3, followed by conducting arranging action of moving to arrangement position illustrated in FIG. 11 after the paper falls on the tray 12 to stop completely with the paper stacked. At this time point, since a paper sheaf SS piled on the tray 12 is arranged, the arranging members 102*a*, 102*b* wait while moving to the acceptance position of FIG. 10 in order to enter acceptance condition of next paper again.

At the time point of ending one series of job concerning arranging action corresponding to predetermined number of papers while repeating such action, the arranging members 102*a*, 102*b* move to the home position illustrated in FIG. 9 again.

Thus, the arranging sections 102*a*1, 102*b*1 of the arranging members 102*a*, 102*b* are capable of being located at least at two positions of at least the acceptance position illustrated in FIG. 10 and so forth and the arrangement position illustrated in FIG. 11 by using moving means such as the stepping motors 104*a*, 104*b*, the receiving pedestals 105*a*, 105*b* containing the shields 105*a*1, 105*b*1, the timing belts 106*a*, 106*b*, the shaft 108, the guide shaft 109 and so forth, the home position sensor 107*a*, 107*b*, and so forth, and the control means. In such a manner described above, it is possible to accept and arrange the paper in which movement amount of the arranging members 102*a*, 102*b* on the occasion of arranging action is smaller movement amount than movement amount from the home position by setting the acceptance position.

c-3: Evacuating Means of Arranging Member

In FIG. 6 to FIG. 8, and FIG. 14 to FIG. 16, the arranging member 102*a* is fitted to be engaged by the shaft 108 as described above, and further, at portion of upstream side of the discharge direction "a" with fitting-engaged section as base point, an L-shaped notch is formed. Concerning this notch, when the arranging member 102*a* is located at the arrangement operation position illustrated in FIG. 14, aspect that becomes condition of being parallel to approximate horizontal direction is called as a push-movement face to be indicated by using reference numeral 102*a*4. Similarly, a push-movement face 102*b*4 in connection with the arranging member 102*b* is also formed.

A shaft 110 in parallel to the shaft 108 comes into contact with these push-movement faces 102*a*4, 102*b*4 with own weight. Both end sections of shaft longitudinal direction of the shaft 110 are recessed to be engaged with up and down movement free by using lengthwise holes 90*a*, 90*b* in vertical direction formed at side plate section of the frame 90.

Figure 14:
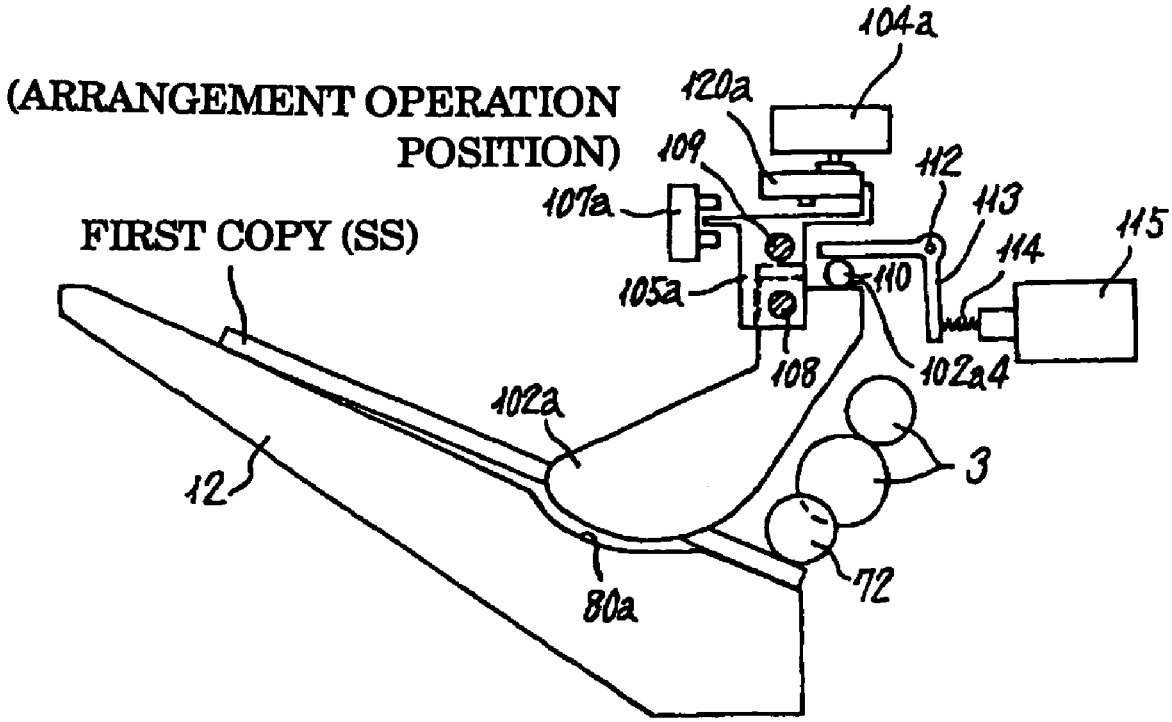
FIG. 14 is an elevation view for explaining the arranging member of being located at the arrangement operation position.

As illustrated in FIG. 4, FIG. 6, and FIG. 14, one end side of an L-shaped lever 113 of being supported by the frame 90 in connection with its shaft 112 is on with own weight at central section of the shaft 110. The other end side of the lever 113 is connected with a plunger of a solenoid 115 via a spring 114. The solenoid 115 is provided at the frame 90.

Figure 16:
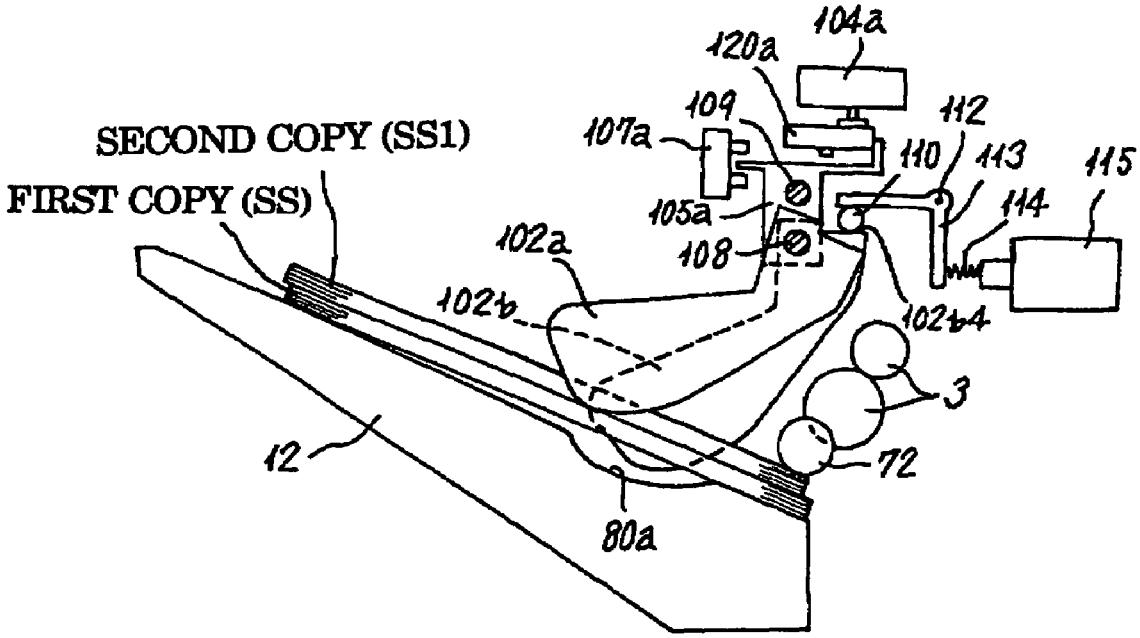
FIG. 16 is an elevation view of the arranging member corresponding to FIG. 13(*b*)

In the condition that the solenoid 115 is OFF (non excitation), as illustrated in FIG. 7, FIG. 8(solid line), the upper end edge section 102*a*3 of the arranging members 102*a*, 102*b* is located at arrangement operation position (referring to FIG. 14) of being contacted with the inner part of the slit 105*a*1 depending on moment by own weight, or the upper end edge section 102*a*3 is located at the position of indicating in FIG. 16 (two-dotted chain line), a little apart from the inner part of the slit 105*a*1, caused by the fact that the lower end section of the arranging members 102*a*, 102*b* comes into contact with the papers on the tray 12. In these positions, the arranging members 102*a*, 102*b* are in the condition that they are located within the concave sections

80*a*, 80*b* of upper surface of the tray 12 or they come into contact with the top surface section of paper piled on the tray 12 as described above.

Figure 15:
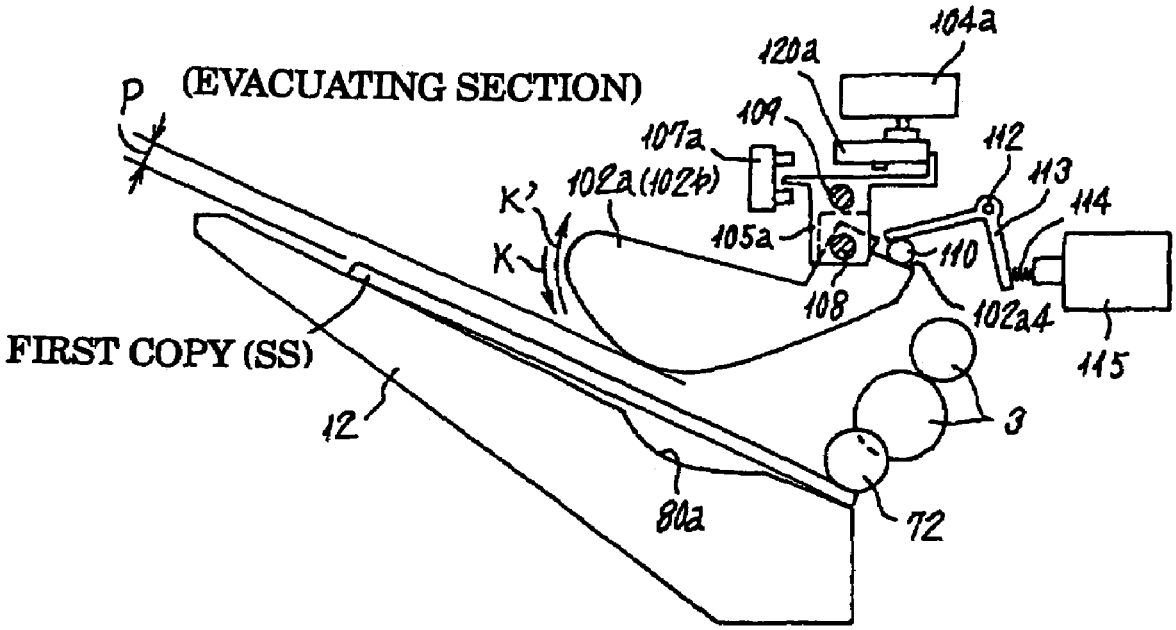
FIG. 15 is an elevation view for explaining the arranging member of being located at the evacuation position.

As illustrated in FIG. 15, when the solenoid 115 is ON (excitation), the plunger of the solenoid 115 is pulled, then the lever 113 rotates. Accompanying this operation, as illustrated in FIG. 8 (two-dotted chain line), FIG. 15, the shaft 110 is pushed down by the lever 113 while being guided by using the lengthwise holes 90*a*, 90*b* provided at the frame 90.

As illustrated in FIG. 6 to FIG. 8, FIG. 14 to FIG. 16, since the shaft 110 is engaged with the push-movement faces 102*a*4, 102*b*4 in the notch formed at the arranging members 102*a*, 102*b*, as illustrated in FIG. 8 (two-dotted chain line), the arranging members 102*a*, 102*b* rotate in the direction of arrow K' of being reverse direction of arrow K caused by the fact that the shaft 110 is pushed down, and move from inside of the concave sections 80*a*, 80*b*, or from the top surface of the paper piled on the tray 12 to upward position of the tray 12 apart from the paper.

Thus, the position illustrated in FIG. 8 (two-dotted chain line), FIG. 15 in which the arranging members 102*a*, 102*b* of the tray 12 evacuate upward direction is called as an evacuation position. The shaft 110, the lever 113, the solenoid 115 and so forth constitute an evacuating means for putting the arranging members 102*a*, 102*b* to the evacuation position.

c-4: Arranging Member Operating Device

In FIG. 6, FIG. 7, FIG. 14, and FIG. 15, configuration part of supporting the arranging members 102*a*, 102*b* is capable of being grasped as configuration that comprises rotation avoidance members made up of the shaft 108 as a fulcrum shaft for fitting to engage these arranging members 102*a*, 102*b* in common, the shaft 110 as a push-movement shaft for rotating these arranging members 102*a*, 102*b* with the shaft 108 as the center while contacting the push-movement faces 102*a*4, 102*b*4 as the respective working points on the arranging member shifted from the shaft 108, and the receiving pedestals 105*a*, 105*b* of providing respective inner parts of the slits 105*a*1, 105*b*1 capable of avoiding rotations caused by moment with the shaft 108 as the center by own weight of the arranging members 102*a*, 102*b*, in which the shaft 108 shares a guide shaft for guiding the arranging members 102*a*, 102*b* toward the shift direction "c" to be arrangement direction and the receiving pedestals 105*a*, 105*b* share driving means for moving the arranging members 102*a*, 102*b* toward the shift direction "c", further, the configuration part is one which is provided with one pair of arranging members for conducting arranging action of arranging position of the end face while moving in the arrangement direction of approaching to and of departing from these end faces so as to put two end faces of the sheet-shaped medium therebetween.

If this configuration is called as an arranging member operating device, the arranging member operating device is capable of contacting the arranging members 102*a*, 102*b* on the upper surface of the paper S with load corresponding to moment by own weight, and it is possible to adjust freely the contact pressure to the paper S in such a way as to adjust the load, when there is no paper S on the tray 12, as illustrated in FIG. 8 by using solid line, it is possible to place the arranging members 102*a*, 102*b* within the concave sections 80*a*, 80*b* of the tray 12 under the condition that the upper section of the arranging member 102*a* is made to engage to be supported at the inner part of the slit 105*a*1, in addition, as illustrated in FIG. 13, FIG. 16, the arranging member operating device permits complete contact of the arranging sections 102*a*1, 102*b*1 to the end face of the paper S.

Further, in the arranging member operating device, there is provided a switch drive means comprising mainly the lever 113 and the solenoid 115, in which the condition of pushing to move the push-movement faces 102*a*4, 102*b*4 as the working points while working to the shaft 110 as a push-movement shaft is switched freely to the condition of releasing the push-movement, whereby, it is possible to switch the conditions between the condition in which the arranging members 102*a*, 102*b* evacuate from the top surface of the paper S and the condition in which the arranging members 102*a*, 102*b* come into contact with the paper S due to rotational moment by own weight at the same time with both the arranging members 102*a*, 102*b*.

c-5: Relationship Between Arranging Member and Concave Section

When the arranging members 102*a*, 102*b* are placed at the arrangement operation position illustrated in FIG. 7, FIG. 8, FIG. 14 and so forth, the lower end section of the arranging members 102*a*, 102*b* enter partly within the concave sections 80*a*, 80*b* provided on the tray 12, with no interference condition to the tray 12. The tray 12 at this time is controlled to be placed at the correct discharge position by using the positioning means 96 (referring to FIG. 2(*b*)) in up and down direction of the tray.

As illustrated in FIG. 1, FIG. 2(*a*), FIG. 7 and so forth, since the concave sections 80*a*, 80*b* are formed, the lower end sections of the arranging members 102*a*, 102*b* are capable of being placed within concave sections 80*a*, 80*b*, namely, are capable of being located at lower portion than the upper surface of the tray 12, whereby the lower end sections of the arranging members 102*a*, 102*b*, more specifically, the arranging sections 102*a*1, 102*b*1 located within the lower end section of the arranging members 102*a*, 102*b* can be made to locate at the position of arranging the lowest paper, thus, the arranging members 102*a*, 102*b* are capable of arranging about the paper S at the lowest position while obtaining the conditions of crossing the arranging sections 102*a*1, 102*b*1 located at the inside of lower end section of the arranging members 102*a*, 102*b* against the end face of the paper S certainly via the concave sections 80*a*, 80*b*.

Arranging action of the paper by using the arranging members 102*a*, 102*b* is conducted only at the time at least one of the arranging members 102*a*, 102*b* is placed within the concave sections 80*a*, 80*b*. The concave sections 80*a*, 80*b* are enough large of accepting stroke range of the arranging members 102*a*, 102*b* when conducting arranging action in order that arranging action of the arranging members 102*a*, 102*b* is capable of being conducted between the home position illustrated in FIG. 9 and the acceptance position illustrated in FIG. 10, so as to avoid interference against the tray 12 during action. In the present example, the concave sections 80*a*, 80*b* has lengthwise shape in the shift direction "c", and being opened at the end face section of the tray 12.

As for the paper S of being discharged on the tray 12, paper of various sizes are scheduled. In the case of the paper of the minimum size, movement amount on the occasion of arranging action of the arranging members 102*a*, 102*b* becomes the largest value, in such a case of the paper of the smallest size, the size of the concave sections 80*a*, 80*b* is enough large to accept the arranging members 102*a*, 102*b*.

Figure 18:
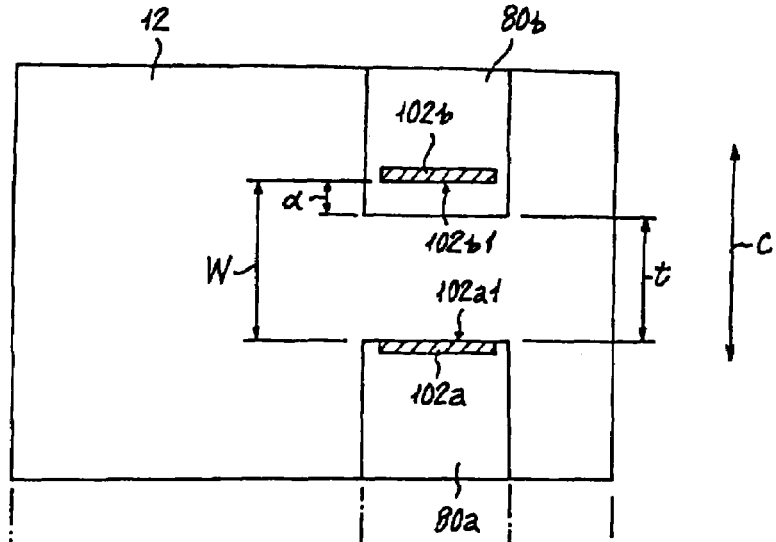
FIG. 18(*a*) is a plan view of the tray.
Figure 18:
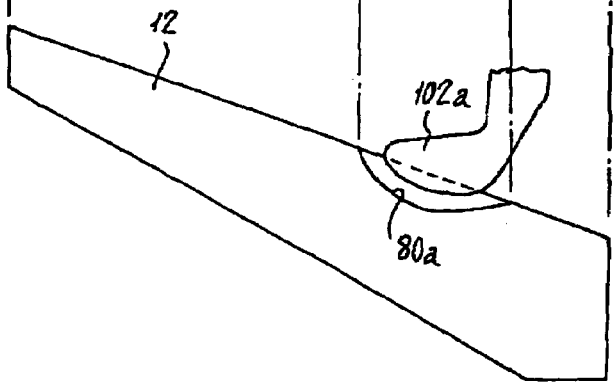

In FIG. 18(*a*), 18(*b*), supposing that paper width of the minimum size is taken to be t', the minimum intervals t of the concave sections 80*a*, 80*b* is taken to be t'>t.

In the one side movement aspect of the arranging actions, for instance, the arranging member 102*a* is made not to move at the position in the direction of inside end of the concave section 80*a*, and the arranging member 102*b* is made to wait at the position of securing wait interval W capable of accepting the minimum sized paper while including margin of appropriate shift from inside end of the concave section 80*b*.

At FIG. 18(*a*), the maximum movement amount of the arranging member 102*b* is distance a to inside end of the concave section 80*b*, thus the arranging member 102*b* is made to move within the range of the maximum movement amount a to contact to arrange the end face of the minimum sized paper.

In addition, in the both side movement aspect, at FIG. 18(*a*), the arranging members 102*a*, 102*b* are made to secure the wait interval W at the position of dividing equally from respective inside ends of the concave sections 80*a*, 80*b* while allowing respective arranging members 102*a*, 102*b* to move by ½ of movement amount in the one side movement aspect in order to arrange the paper.

About the minimum sized paper, it is possible to operate the arranging members 102*a*, 102*b* without interrupting against the tray 12 in connection with the minimum sized paper in such a way as to form the minimum interval t of the concave sections 80*a*, 80*b* in order that the arranging members can be made to accept within the range capable of conducting arranging action in connection with the minimum sized paper.

In the example of FIG. 18, the arranging section 102*a*1 of the arranging member 102*a* is located at the vicinity (or position with a little margin) of the inside of the concave section 80*a* as illustrated in the drawing, and supposing that the arranging section 102*a*1 moves in the direction of departing from inside end of the concave section 80*a* from this condition, the concave sections 80*a*, 80*b* have the size capable of receiving the arranging members 102*a*, 102*b* even though the arranging member 102*b* moves within the range of the maximum shift amount a. For that reason, the concave sections 80*a*, 80*b* are capable of avoiding interference between the tray and the arranging members also in the case of sorting/arranging of the minimum sized papers.

It should be noted that the concave sections 80*a*, 80*b* do not need so much depth if object is one in which the concave sections 80*a*, 80*b* are only made to overlap to the arranging members 102*a*, 102*b*, however in cases where the concave sections 80*a*, 80*b* share gap of entering hands on the occasion that the papers are taken out, it is enough to form the concave sections 80*a*, 80*b* with the size depending on the function.

In FIG. 18, the concave sections 80*a*, 80*b* not only have the minimum interval t about the shift direction "c", but also it is necessary that, about depth direction, the lower end sections of the arranging members 102*a*, 102*b* are placed within the concave sections 80*a*, 80*b* through the time of acceptance and arranging action. For that reason, in FIG. 7, FIG. 8, gap of β is made to secure between bottom of the concave sections 80*a*, 80*b* and the lower end sections of arranging members 102*a*, 102*b*.

In the condition that the paper is not piled on the tray 12, the lower end sections of the arranging members 102*a*, 102*b* are placed within the concave sections 80*a*, 80*b*. In addition, the concave sections 80*a*, 80*b* end while remaining the minimum interval t at the center section of the tray 12. Accordingly, if the arranging members 102*a*, 102*b* move in the direction of approaching with each other caused by error action, there is danger of being damaged the arranging members 102*a*, 102*b* while colliding step section of the minimum interval t. For that reason, a safety switch is provided in order to stop drive of the stepping motors 104*a*, 104*b* when the arranging members 102*a*, 102*b* arrive at arbitrary position of approaching to end of the concave sections 80*a*, 80*b* of the minimum interval t, thus the condition is made to set in which the arranging members 102*a*, 102*b* do not collide the concave sections 80*a*, 80*b* in order not to be damaged.

c-6: Interference Avoidance Between Arranging Member and Paper

After the job ends, when the arranging members 102*a*, 102*b* move mutually from the acceptance position illustrated in FIG. 12 to the acceptance position illustrated in FIG. 13(*a*), the paper sheaf with considerable effort to arrange are caught on the lower end section of the arranging members 102*a*, 102*b* to be confused accompanying shift action. For that reason, in order to avoid this affair, before the arranging members 102*a*, 102*b* shift, the arranging members 102*a*, 102*b* are made to part and to evacuate from the paper by using the evacuating means beforehand.

It is necessary to move arranging members 102*a*, 102*b* to the position of further narrowing interval than the acceptance position in order to prepare for the case of being changed paper width on the occasion that the sorting/arranging of the predetermined number of copies end, followed by conducting next sorting/arranging of the predetermined number of copies. On the occasion of movement of the arranging members 102*a*, 102*b* according to the above reason, the arranging members 102*a*, 102*b* are made to evacuate in order to avoid that the arranging members 102*a*, 102*b* interfere with the papers on the tray 12 that are already arranged.

In FIG. 6 to FIG. 8, FIG. 14, FIG. 15 and so forth, the shaft 110, the lever 113, the solenoid 115 and so forth constitute the evacuating means for putting the arranging members 102*a*, 102*b* to evacuation position.

Before the arranging members 102*a*, 102*b* move, as illustrated by using two-dotted chain line in FIG. 8, as illustrated by using solid line in FIG. 15, the arranging members 102*a*, 102*b* are made to put at the evacuation position with the solenoid 115 turned ON beforehand by using the evacuating means. Or, when the sorting/arranging of the predetermined number of copies is completed, the arranging members 102*a*, 102*b* are made to put at the evacuation position if necessary.

In the evacuation position as illustrated in FIG. 8, the lower end section (part of overlapping with tray 12) of the arranging member is pushed up with the result that gap takes place at the tray 12 therebetween. Since the tray 12 moves in the shift direction "c" for conducting the sorting as the gap takes place, it is possible to avoid contact between the top surface of the paper and the arranging members 102*a*, 102*b*.

The arranging members 102*a*, 102*b* put at the evacuation position illustrated in FIG. 15 by using the evacuating means are capable of being placed at the position illustrated in FIG. 13(*a*), FIG. 16 and so forth due to moment by own weight of the arranging members 102*a*, 102*b* by only the fact that the solenoid 115 is made to turn OFF.

As illustrated in FIG. 13(*a*), in the case of one side movement aspect about arranging action, when the arranging members 102*a*, 102*b* are restored to the position capable of conducting arranging operation caused by OFF of the solenoid 115 after shifting, one side of the arranging member 102*a* gets on the paper sheaf in the prior job, and the other arranging member 102*b* is located at outside of end face of the paper sheaf in the prior job, while, in the job of this time, the arranging member 102*a* of getting on the paper sheaf moves, and the arranging member 102*b* of locating at out side of end surface of the paper does not move to conduct shift arranging action. In the next job, role thereof is changed.

There is the case in which the paper may be made to take out from the tray 12 after the arranging members 102*a*, 102*b* has completed the arranging action to a series of papers. Also, in this case, if the arranging members 102*a*, 102*b* are placed at the evacuation position illustrated in FIG. 8 (two-dotted chain line), ejection of the paper sheaf after sorting/arranging from the tray 12 becomes easy.

As illustrated in FIG. 5 while enlarging within circle of two-dotted chain line, the arranging members 102*a*, 102*b* form inner edges of respective lower end section so that angle θ becomes sharp angle. Thus, such inner edge with sharp angle can catch the paper S surely at the time of arranging action, it is avoided that the paper S can not be arranged because the paper S enters under the arranging members 102*a*, 102*b*.

On the occasion of sorting/arranging, action of moving the arranging member 102*a* from the acceptance position illustrated in FIG. 13(*a*) to arrangement position illustrated in FIG. 13(*b*) is conducted after discharge of the paper as described later, at this time, as illustrated in FIG. 13(*b*), friction to the top surface of the paper sheaf SS by the arranging member 102*a* liable to cause confusion of the paper of being arranged. Similarly, it might be generated about the arranging member 102*b* at the next cycle.

Accordingly, quality of material is selected so that friction coefficient of part of contacting the paper S to be the lower end section of the arranging members 102*a*, 102*b* becomes smaller than friction coefficient of papers therebetween, and process is made to minimize value of surface roughness, thus friction coefficient of contact portion is minimized than friction coefficient of the papers therebetween. For that reason, on the occasion of evacuating action or removal of the evacuating action, the copies (paper sheaf) after arrangement are not disarranged.

[2]-5: Arranging Function, Shift Arranging Function (a. Action for only Arrangement)

Hereinafter, there will be described about arranging function and shift arranging function by using the arranging members 102*a*, 102*b* in the arranging means 100 at the time of arrangement mode in the above ③ and the arranging member driving device 99.

As illustrated in FIG. 9, in immediately after apparatus start, the arranging members 102*a*, 102*b* are placed at the home position, and intervals of the arranging members 102*a*, 102*b* is maintained in the opposite interval M. In default position of the arranging member, the shields 105*a*2, 105*b*2 of the receiving pedestals 105*a*, 105*b* are inserted in respective home position sensors 107*a*, 107*b* to be detected, thus being stopped at the position of being detected.

At the time of clear mode start as the paper is discharged on the tray 12, namely, before discharging of the paper, these arranging members 102*a*, 102*b* move at the acceptance position illustrated in FIG. 10 or FIG. 12(*a*) beforehand.

On the occasion of arrangement in the both side movement aspect, in FIG. 10, the arranging member 102*a* is placed at the position 5 mm apart from the end section of the paper sheaf SS to be piled with the receiving pedestal 105*a* guided by the shaft 108 in such a way as to drive the stepping motor 104*a*.

In addition, in the arrangement of one side movement aspect, as illustrated in FIG. 12(*a*), similar to the above, the arranging member 102*b* is placed at the position 5 mm apart from the paper end section, and the arranging member 102*a* is placed at the position 10 mm apart from the end section of the paper sheaf SS in such a way that the receiving pedestal 105*a* is guided by the shaft 108 due to drive of the stepping motor 104*a*. Thus, the respective arranging members 102*a*, 102*b* wait at the respective acceptance positions through being subjected to independent drive.

In the both side movement aspect, as illustrated in FIG. 11, after the paper falls on the tray 12, the arranging members 102*a*, 102*b* operate to conduct arrangement while striking end face of the paper through the receiving pedestals 105*a*, 105*b* due to drive of the stepping motors 104*a*, 104*b*.

In the one side movement aspect, as illustrated in FIG. 13(*b*), the paper is arranged while moving only the arranging member 102*a* due to drive of only the stepping motor 104*a*. In any movement method, movement of the arranging members 102*a*, 102*b*, as illustrated in FIG. 11 or FIG. 12(*b*), is conducted to the degree that the arranging member cut into a little to the paper width in order to absorb curl of the paper or variation of the paper size.

After completing arrangement of the paper, as illustrated in FIG. 10 or FIG. 12(*a*), in order to conduct preparation of arrangement of the next papers, respective arranging members 102*a*, 102*b* are made to move to the acceptance position with gap of 5 mm to the paper width again, subsequently, setting to the conditions of FIG. 11 or FIG. 12(*b*), thus such reciprocating action is conducted to the whole paper discharged to the tray 12. Above is fundamental arranging action of the arranging members 102*a*, 102*b* for only arrangement.

(b. Sorting/Arranging Action)

Hereinafter, explanation will be made about sorting/arranging action at the time of sorting/arranging mode in the above ④.

In the first place, in order to conduct paper arrangement about the first copy, the arranging members 102*a*, 102*b* move to the acceptance position illustrated in FIG. 12(*a*) from the home position. In the acceptance position, one side of the arranging member, in this case, the arranging section 102*a*1 of the arranging member 102*a* waits with 10 mm gap against the paper end face (end face of paper sheaf SS) thus discharged, while, the other side of the arranging member, in this case, the arranging section 102*b*1 of the arranging member 102*b* waits with 5 mm gap against the paper end face (end face of paper sheaf SS) thus discharged. Consequently, respective arranging members 102*a*, 102*b* wait at the positions of being non symmetrical to a paper transfer center O-O.

Here, after the paper falls on the tray 12, the arranging section 102*a*1 of the arranging member 102*a* of waiting with gap of 10 mm from the paper end face (end face of paper sheaf SS) leaves at its position, while, the arranging section 102*b*1 of the arranging member 102*b* of waiting with gap of 5 mm from the paper end face moves in the direction of arrow Jb in FIG. 12(*b*) in the same way as the time of the arrangement mode, followed by conducting arrangement while striking end face of the paper. At this time, paper end face of reverse side becomes condition in which the paper end face is struck to the arranging section 102*a*1 of the arranging member 102*a*, thus the arranging member 102*b* moves as long as the arranging sections 102*a*1, 102*b*1 of the both arranging members cut into 1 mm than the paper width to arrange the papers.

Consequently, when conducting arrangement of the paper sheaf SS of the first copy, movement amount of the arranging member 102*a* is 0 mm, and movement amount of the arranging member 102*b* becomes 17 mm, thus the arranging member 102*b* conducts arranging work while conducting reciprocating action of 17 mm stroke to each paper. In this case, the paper sheaves SS of the first copy are piled with 10 mm shifted to the side of the arranging member 102*a* against the paper transfer center O-O. It should be noted that, in the above example, it is no problem if the role of the arranging member 102*b* is changed into the role of the arranging member 102*a*.

Next, about example in which the second copy of the paper sheaf SS1 shifts to the first copy of the paper sheaf S to be piled is explained based on FIG. 13(*a*), FIG. 13(*b*). In FIG. 12(*a*), 12(*b*), after the arranging work of the first copy (paper sheaf SS) is completed entirely, as illustrated in FIG. 13(*a*) at this time, in reverse to the first copy, the arranging member 102*b* moves to wait with gap of 10 mm against the end face of the paper (paper sheaf SS1) thus discharged with the paper transfer center O-O as the center, while, the arranging member 102*a* moves to wait with gap of 5 mm against the end face of the discharged paper (paper sheaf SS1). Consequently, positions of both arranging members reverse against the paper transfer center O-O in comparison with the case of the first copy of SS.

Here, after the paper falls on the tray 12, the arranging member 102*b* of waiting with gap of 10 mm from the paper end face (end face of paper sheaf SS1) leaves at its position, while, the arranging member 102*a* of waiting with gap of 5 mm from the paper end face moves in the direction of arrow Ja in FIG. 13(*b*), followed by conducting arrangement while striking end face of the paper.

In the sorting/arranging mode described above, direction of bringing near the paper is only separated into the arranging member 102*b* of rear side or the arranging member 102*a* of front side between the odd number copies and the even number copies, accordingly, fundamental arranging action is the same. In the case of this time, since arrangement of the paper is conducted in such a way that paper of the first copy is made to move 10 mm to the front side, and that paper of the second copy is made to move 10 mm to the rear side, shift amount (gap amount) between the first copy (paper sheaf SS) and the second copy (paper sheaf SS1) becomes, as illustrated in FIG. 13(*b*), 20 mm, thus separation between the copies is completed.

Here, operation is explained with reference to FIG. 14 to FIG. 16 until arrangement of the first paper of the second copy (paper sheaf SS1) is conducted (condition of FIG. 13(*b*)) after arranging the last paper of the first copy (paper sheaf SS). FIG. 14 is one in which condition of FIG. 12(*b*) is seen from the side (front side) of the arranging member 102*a*. After completing arrangement of the last paper of the first copy (paper sheaf SS), the arranging members 102*a*, 102*b* rotate in the direction of arrow K' of FIG. 15 in such a way as to turn ON the solenoid 115, so that gap p is formed to the paper sheaf SS of the first copy therebetween.

The arranging members 102*a*, 102*b* are made to move in the shift direction "c" while avoiding contact to the paper sheaf SS with this gap p maintained. The arranging members 102*a*, 102*b* move from the position illustrated in FIG. 12(*b*) to the position illustrated in FIG. 13(*a*).

After, the arranging members 102*a*, 102*b* move at the position illustrated in FIG. 13(*a*), the solenoid 115 is made to turn OFF to stop excitation, and rotation of the arranging members 102*a*, 102*b* of rotating upward is made to terminate, whereby, the condition is made one that is illustrated in FIG. 16. The front side arranging member 102*b* becomes condition of being dropped from the paper end face, and the rear side arranging member 102*a* becomes condition of being contacted while getting upon the top surface of the first copy (paper sheaf SS).

As to second copy (paper sheaf SS1) and later, both arranging members 102*a*, 102*b* are alternated, as illustrated in FIG. 16, in which the arranging member of contacting on the top surface of respective copies moves, while the other arranging member becomes a stopper that is not moved to conduct arrangement of the paper.

As illustrated in FIG. 3, the transferred paper is discharged on the tray 12 by using the paper discharge roller 3, then, rear end section of the paper drops out to depart from the paper discharge roller 3, after that the paper is piled on the tray 12 via free fall descent, since the paper falls under free condition without any restriction through free fall descent distance L, lateral gap amount Δ occurs between the papers caused by affect of air and so forth, thus arrangement deteriorates, however, as the present embodiment, it is possible to correct the arrangement deterioration due to arranging function or the shift arranging function of the arranging members 102*a*, 102*b* in the arranging means 100.

The arranging means 100 is one in which the shift action of the tray 12 as the conventional art is not conducted, but additional drive of using the stepping motors 104*a*, 104*b* is conducted, therefore, it is possible to obtain the sorting/arranging function for the sorting by using small drive power without respect to size of load capacity on the tray 12, and it is possible to arrange the paper in high precision.

(c. Thoughtful Consideration on Configuration of Arranging Member)

Above is the arranging function of the arranging members 102*a*, 102*b* at only fixed position on the shift direction "c", and if sorting/arranging function is added to the arranging function described above, it becomes necessary to be provided with following correspondence.

First, in cases where arrangement of the paper is conducted by using the arranging members 102*a*, 102*b*, the paper arrangement is conducted while moving the respective arranging members 102*a*, 102*b* from the paper transfer center O-O alternately in every each job.

Namely, when bringing to arrange the paper sheaf on the tray 12 close to front side against the paper transfer center O-O, the respective arranging members 102*a*, 102*b* are made to move to the front side to arrange, while when bringing to arrange the paper sheaf on the tray 12 close to rear side against the paper transfer center O-O, the respective arranging members 102*a*, 102*b* are made to move to the rear side to arrange.

Figure 17:
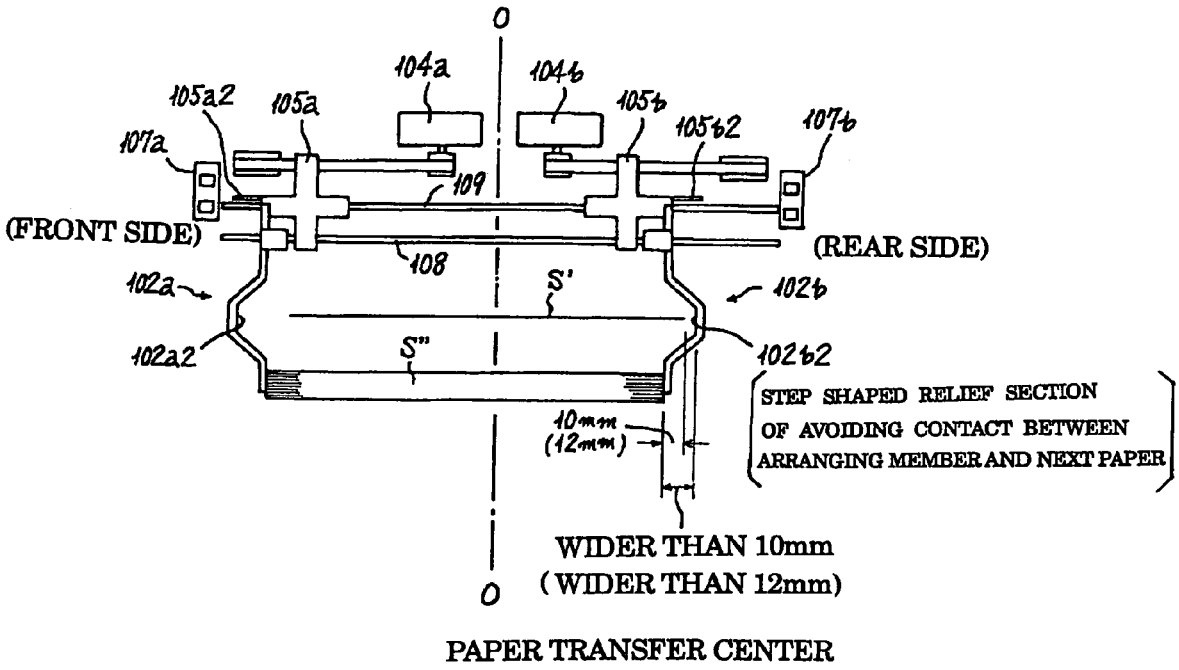
FIG. 17 is an outline elevation view of the arranging member of being explained about relief section of the arranging member as seen from the side of the paper discharge roller.

For instance, as illustrated in FIG. 17, when next paper S' is transferred between the arranging members 102*a*, 102*b* of conducting arranging action while shifting to the front side, the more the image forming apparatus becomes high speed one, the more the next paper S' is transferred during the paper S" to be copies of belonging to previous time is arranged.

In the present example, there are provided the step shaped relief sections 102*a*2, 102*b*2 at respective upper sections of the arranging sections 102*a*1, 102*b*1 so that the next paper S' does not come into contact with the arranging members 102*a*, 102*b* in such a case. As illustrated in FIG. 9, interval F' between the relief section 102*a*2 and the relief section 102*b*2 is wider than the interval M between the arranging member 102*a* and the arranging member 102*b*, specifically, in FIG. 17, for instance, about side of the arranging member

102*a*, step shaped relief amount is wider than half (10 mm) of paper sheaf gap (shift) amount between previous paper S" and the next paper S'.

It should be noted that if cutting amount (1 mm at one side) of the arranging section toward paper end section at the arranging time is taken into consideration, it is suitable that one side of step shaped relief amount is wider than 12 mm that is interval in which cutting amount (2 mm) toward inside from end section of the paper at the time of arranging is added to half (10 mm) of the shift amount. Thus, it is possible to avoid contact to the next paper S' surely in such a way as to widen the step shaped relief sections 102*a*2, 102*b*2 from the arranging sections 102*a*1, 102*b*1, with the result that it is possible to cope with the high speed image forming apparatus.

(d. Thoughtful Consideration on Action of Arranging Member)

Following correspondence becomes necessary if the sorting/arranging function in addition to the arranging function on the tray are made to possess to the arranging members 102*a*, 102*b*. In the present example, after completing arrangement job last paper by using the arranging members 102*a*, 102*b*, as explained in FIG. 8, the arranging members 102*a*, 102*b* rotate upward with the shaft 108 as the center to arrive at the condition of taking shelter from the piled surface of the paper while departing from the surface. The arranging members 102*a*, 102*b* should avoid contact to the paper sheaf already piled while moving toward the shift direction "c" in order to conduct arranging work for the next job under the condition of departing from the piled surface namely under the condition of being rotated. It follows that, in order to conduct arranging work of the next job without disturbing arrangement of the piled paper sheaf, an evacuation means is provided in which the arranging members 102*a*, 102*b* are capable of moving with evacuated condition (condition of departing from piled surface) maintained, which evacuated condition is one in which the arranging members 102*a*, 102*b* are evacuated upward while rotating from front side to rear side or rear side to front side.

In cases where the arranging members 102*a*, 102*b* conduct the sorting, the arranging members 102*a*, 102*b* move with the conditions (condition of departing from piled surface of FIG. 8 (two-dotted chain line), FIG. 15) of being evacuated while rotating from front side to rear side or from rear side to front side maintained, whereby, it is possible to avoid contact between the arranging members 102*a*, 102*b* and the piled paper sheaf, thus it is possible to maintain stable piled condition.

[3] Control Procedure

Sorting action due to control means will be explained with reference to flowchart.

Following flow indicates only part of being related to the present invention on the sheet-shaped medium after-treatment apparatus. Initial routine illustrated in FIG. 19(*a*) is executed as a main switch for supervising the image forming apparatus 50 and the sheet-shaped medium after-treatment apparatus 51 of FIG. 1 is turned ON. In this initial routine, at STEP P1, "jogger initial control" is conducted, so, the arranging members 102*a*, 102*b* move to the home position illustrated in FIG. 9, and respective flags are reset to 0. It should be noted that, on the following flowchart, jogger means the arranging members 102*a*, 102*b* in the above explanation.

Figure 19:
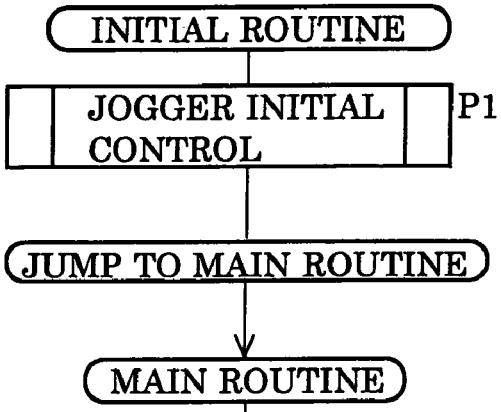
FIG. 19(*a*) is a flowchart for explaining initial routine for arrangement action.
Figure 19:
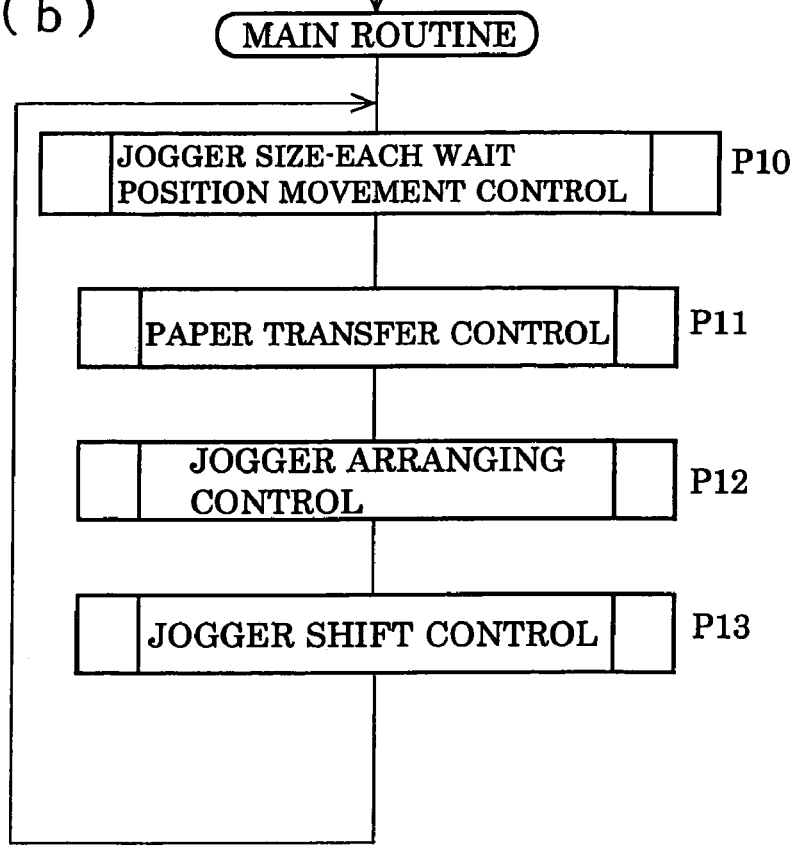

After completing STEP P1, operation flow jumps to main routine of FIG. 19(*b*). FIG. 19(*b*) is a flowchart about control of moving the jogger at the time of job starting to each-size wait position, and is sub routine of being called in the main routine of FIG. 14-1.

FIG. 20, FIG. 21, FIG. 22, and FIG. 23 are flowcharts about control of paper transfer, arranging action and sorting action of paper by using the jogger, and are sub routines of being called in the main routine of FIG. 19(*a*), FIG. 19(*b*).

Figure 20:
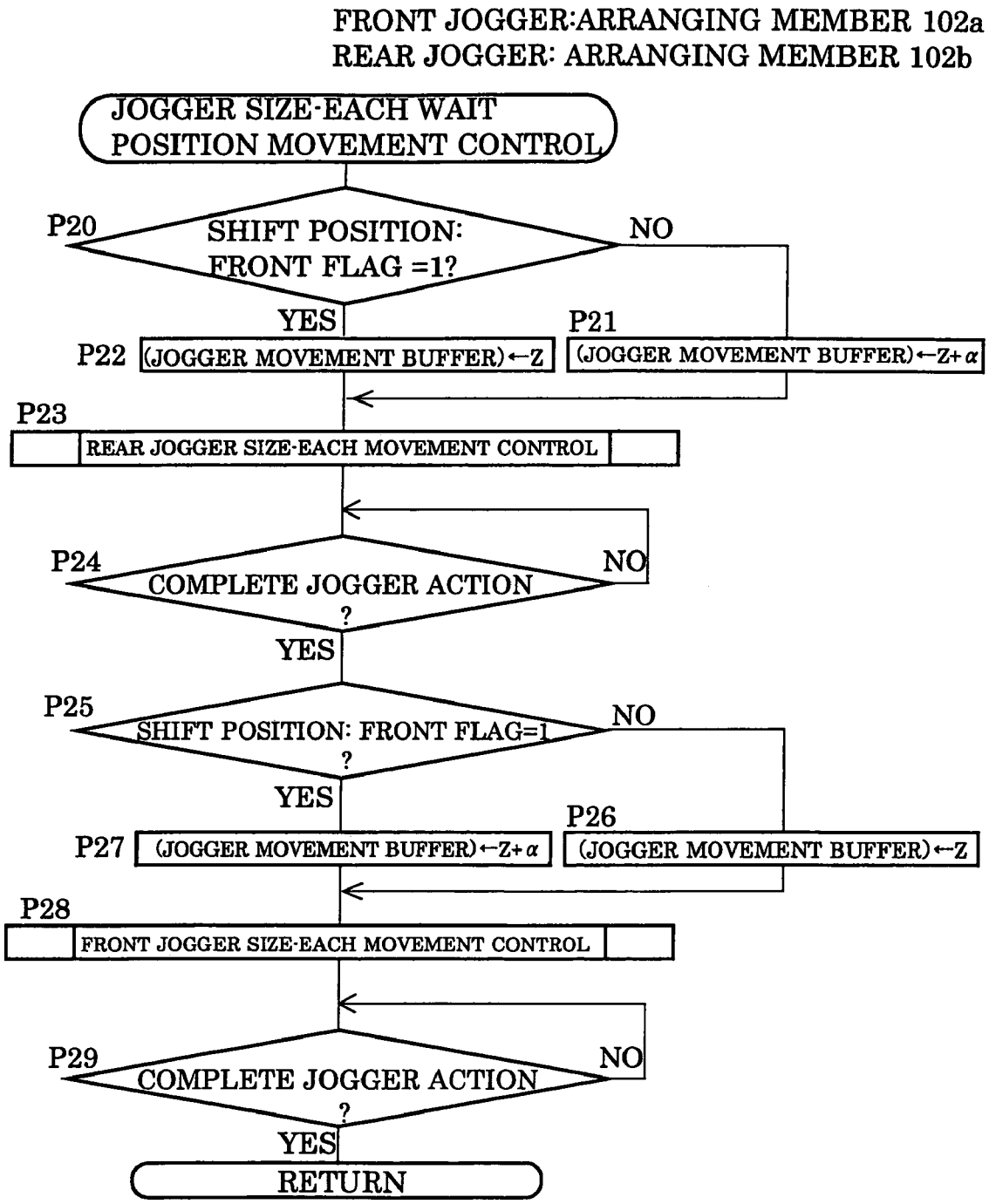
FIG. 20 is a flowchart for explaining procedure of arrangement by using arranging means.
Figure 21:
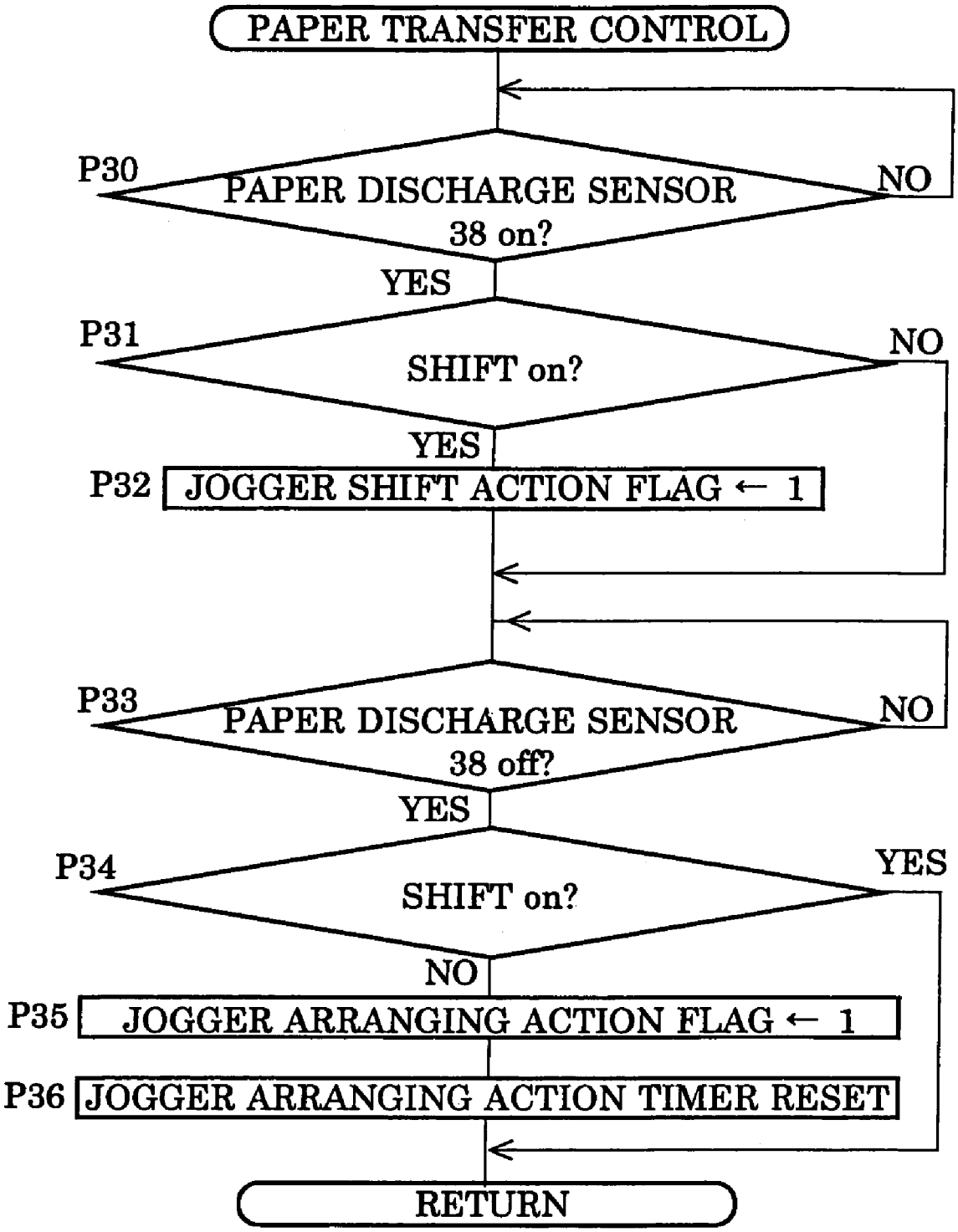
FIG. 21 is a flowchart for explaining procedure of arrangement by using arranging means.

Flow of FIG. 20 indicates each-size movement control of the jogger that is executed at the time the job starts. At the time the job starts, the image forming apparatus 50 transmits command of indicating "activation", and information of paper size and so forth to the sheet-shaped medium after-treatment apparatus at the time the job starts. The present routine is only executed immediately after "activation" command transmission, and ignored except for the above operation.

First, in STEP P20, check of "shift position: front flag=1?" is conducted. Since the whole flags are reset at "jogger initial control" of STEP P1, proceeding to STEP P21 from STEP P20, movement amount of the arranging member 102*b* is determined. "Jogger movement buffer" of next STEP P21 is a buffer for setting the number of pulse of driving the stepping motor 104*b* actually, and corresponding pulse (Z+α) of being set in which the arranging member 102*b* can move from the home position to the acceptance position of FIG. 12(*a*), in which the arranging member 102*b* is moved corresponding to set pulse in "rear jogger each-size movement control" of STEP P23, followed by being conducted check of movement at STEP P24, thus the arranging member 102*b* moves at the acceptance position of FIG. 12(*a*).

Operation flow proceeds to STEP P25 from STEP P24, so, movement amount of the arranging member 102*a* is determined. "Jogger movement buffer" of next STEP P26 is a buffer for setting the number of pulse of driving the stepping motor 104*a* actually, and corresponding pulse (Z) of being set in which the arranging member 102*a* can move from the home position to the acceptance position of FIG. 12(*a*), in which the arranging member 102*a* is moved corresponding to set pulse in "front jogger each-size movement control" of STEP P28, followed by being conducted check of movement at STEP P29, thus the arranging member 102*a* moves at the acceptance position of FIG. 12(*a*). Thus, respective arranging members 102*a*, 102*b* move to acceptance position of FIG. 12(*a*).

It should be noted that if "shift position: front flag" is made to set to 1 beforehand, it is possible to reverse position relationship of the arranging members 102*a*, 102*b* at the acceptance position against to the above description in such a way as to go through STEP P22, and STEP P27.

In the above control, as to pulse control of the stepping motor, detailed explanation is omitted because there is function of various kinds of CPU, "Z" is setting value of moving the arranging member 102*a* to the position of 10 mm departing from the paper size, and "Z+α" is setting value in which the arranging member 102*b* moves to the position of 5 mm departing from the paper size, further, a is setting value of 5 mm of difference thereof.

In the acceptance position illustrated in FIG. 12(*a*), interval from end section of rear side of the paper discharged with the reference of paper transfer center to the arranging section 102*b*1 of the arranging member 102*b* is 5 mm, and interval from end section of front side of the paper to the arranging section 102*a*1 of the arranging member 102*a* is 10 mm, so, these values are equal to, in the acceptance position illustrated in FIG. 13(*a*), 5 mm intervals from end section of front side of the paper discharged with the reference of paper transfer center to the arranging section 102*a*1 of the arranging member 102*a*, and 10 mm intervals from end section of rear side of the paper to the arranging section 102*b*1 of the arranging member 102*b*. For that reason, in the acceptance position, the arranging member of the side of moving on the occasion of conducting arrangement is not located at outside of the end section of the paper of the copy of having arranged at last time, but is located at upper surface of the paper of the copy of having arranged at last time, further, at arranging action, the arranging member operates while always contacting upper surface of the paper, whereby, arranging action can be conducted without disturbing the paper sheaf of the copy of having arranged at last time. This point will be described later.

Next, operation flow proceeds to routine of "paper transfer control". This routine indicates routine for controlling paper transfer within the sheet-shaped medium after-treatment apparatus 51, so, only part necessary for the present invention is described.

The paper is discharged from the image forming apparatus 50, subsequently, in the sheet-shaped medium after-treatment apparatus 51, control of jam detection and so forth by using an entrance sensor 36 is conducted, followed by conducting control of the paper discharge sensor 38.

First, after detecting paper top by the paper discharge sensor 38 at check of "paper discharge sensor on?" of STEP P30, "shift on" command is checked at STEP 31. "Shift on" command is transmitted in every paper of conducting shift, together with information of size and so forth transmitted from the image forming apparatus 50 in every each paper.

Figure 23:
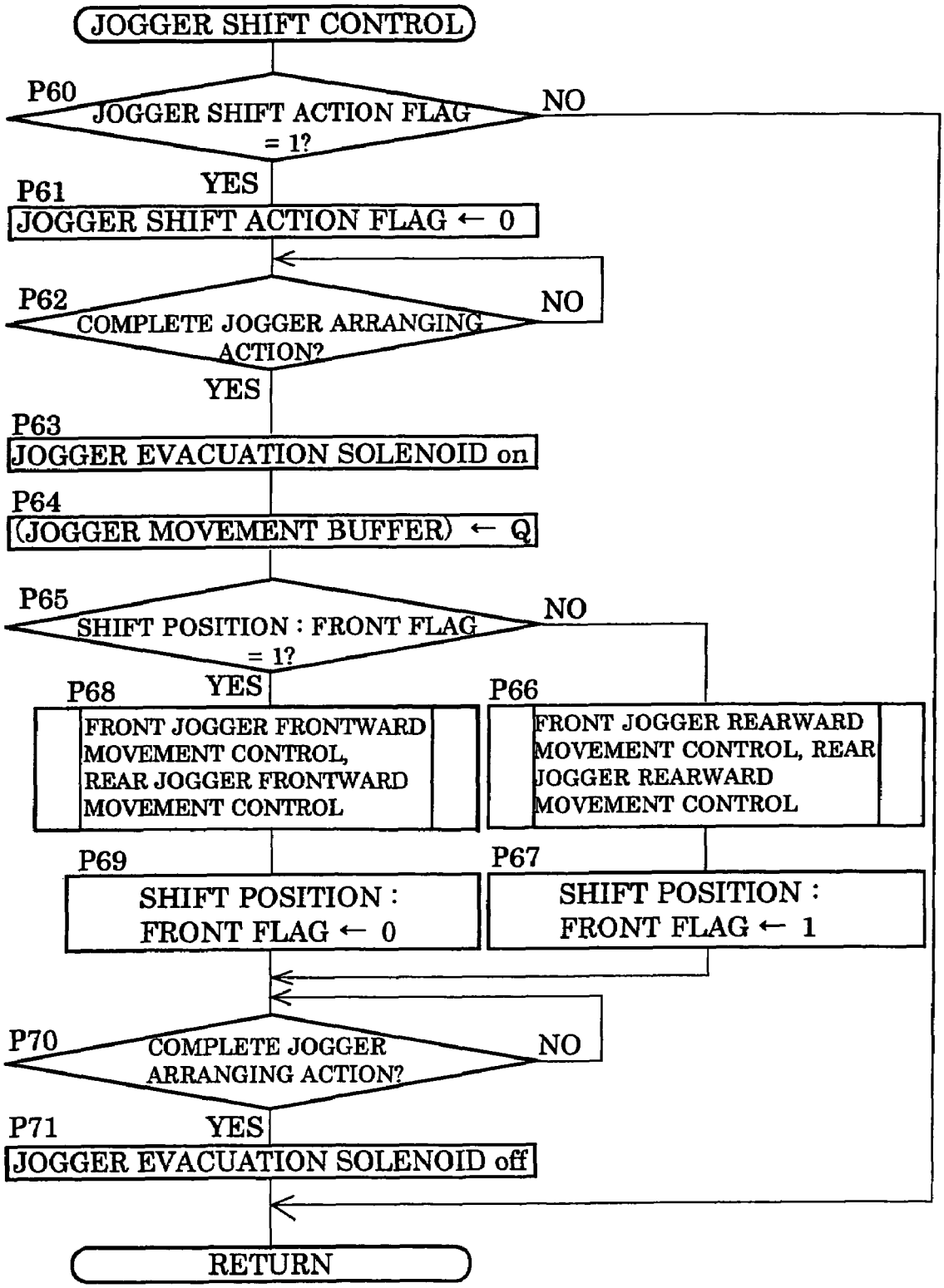
FIG. 23 is a flowchart for explaining procedure of arrangement by using arranging means.

Here, when the shift command is on, shift action is conducted from STEP P60 in FIG. 23 while setting 1 to "jogger shift action flag" at STEP P32. When the shift command is off, nothing is conducted, operation flow proceeds to check of "paper discharge sensor 38 off?" of STEP S33.

In cases where the shift command is off, operation flow proceeds to check of "paper discharge sensor 38 off?" of STEP P33, the time point when rear end of the paper goes through the paper discharge sensor 38 is taken to be trigger, so, going through STEP P34, followed by setting 1 to "jogger arranging action flag" at STEP P35, simultaneously, resetting "jogger arranging action timer" at STEP P36, after conducting not illustrated processing following after that, the present routine is completed.

On the other hand, when the shift command is on, "jogger shift action flag" is made to set to 1 from STEP P31 to STEP P32, and at check of "shift on?" from STEP P32 to STEP P34, operation flow bypasses STEP P35, STEP P 36, and proceeds through to return without conducting respective operations of "jogger arranging action flag←1" and "jogger arranging action of timer reset".

Figure 22:
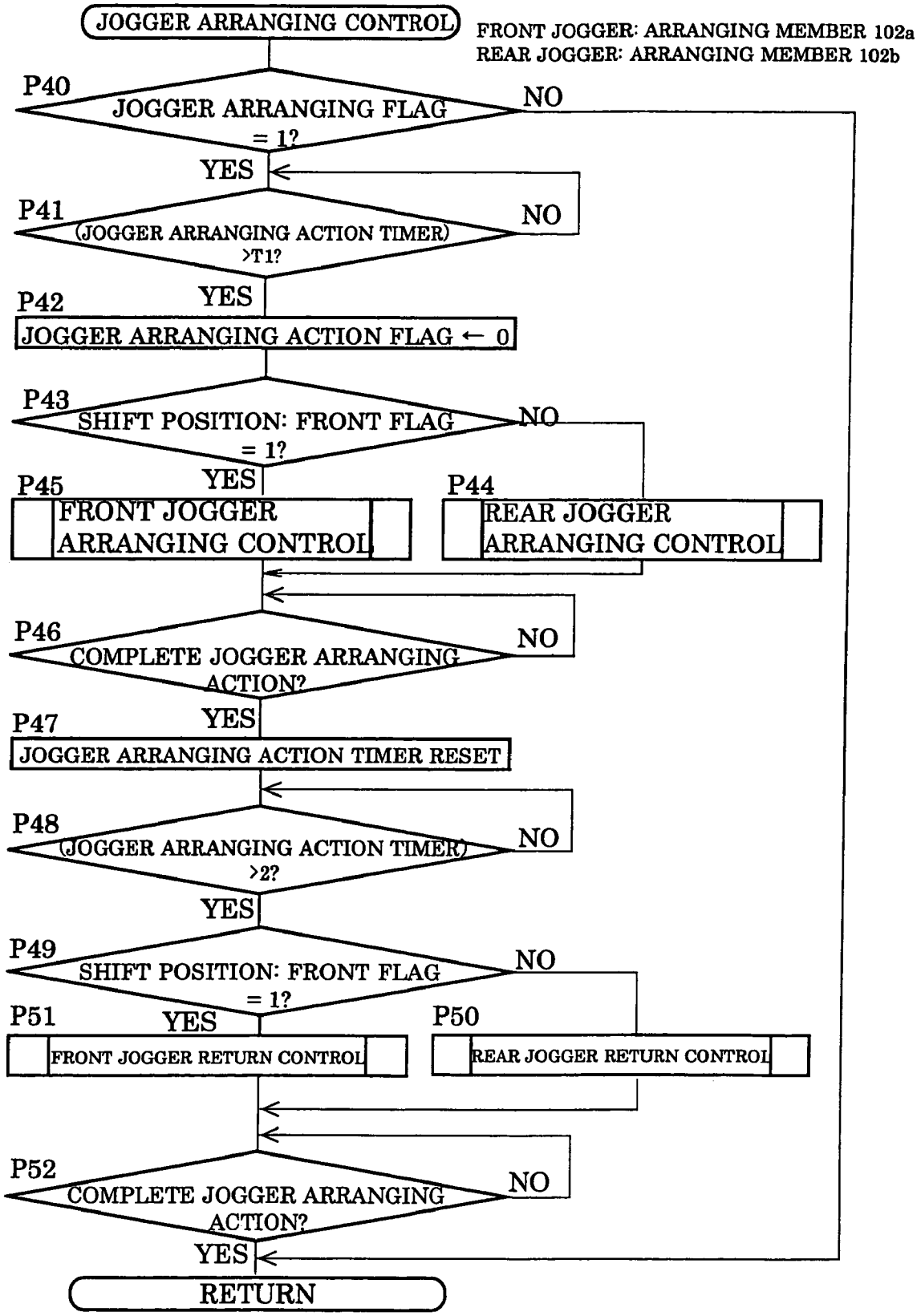
FIG. 22 is a flowchart for explaining procedure of arrangement by using arranging means.

Due to this control, in terms of the paper of conducting shift arrangement, arranging action due to arranging member over STEP P40 and later STEP P41 to STEP P52 in FIG. 22 is not conducted.

As explanation in FIG. 23 described later, on the occasion of action of shift, time is necessary to conduct actions of "arranging member is made to evacuate"→"arranging member is made to shift"→"release of evacuation of arranging member", accordingly, there is danger of not conducting arranging action in addition to shift action at the time of shifting, and evacuating action caused by restriction concerning time in cases where the image forming apparatus 50 becomes high speed one.

Accordingly, essential shift action and evacuating action are conducted preferentially, so, arranging action concerning only first paper of the copy is not conducted. In the present control, about the first paper of the copy after shifting, arranging action immediately after discharge of the paper is not conducted, however, about arrangement of this paper, arranging action of the first paper is conducted together with the arranging action of the second paper in such a way as not to attach "shift on" command as for the paper of being discharged in second order at STEP P34. Even though such operation is conducted, since the first paper is arranged together with the second paper, the arrangement precision is not affected. If the arrangement is conducted at immediately after discharge about the first paper, it is necessary to obtain paper intervals, such operation brings deterioration of productivity. According to the present example, it is possible to permit shift arrangement without deteriorating productivity.

In cases where the shift command is off, when 1 is set to trigger of "paper discharge sensor 38 off" at STEP P33, and to "jogger arranging action flag" at STEP P35 via STEP P34, following respective controls are executed in the flow of FIG. 22.

First, at STEP P40, comparison is made between value of "jogger arranging action timer" and set value T1, if the value of "jogger arranging action timer" becomes larger than T1, at STEP P42, "jogger arranging action flag" is reset to 0, after that, the arranging action is conducted.

Value of the set value T1 is one that is set in consideration of time until rear end of the paper goes through the paper discharge sensor 38 and falls on the tray 12 completely, since, at STEP P43, condition is that "shift position: front flag 0" after the paper falls on the tray 12 completely, operation flow proceeds to STEP P44, the arranging member 102*b* is made to operate to conduct arranging action. The above set value T1 is necessary to set in consideration of distance from the paper discharge sensor 38 to the paper discharge roller 3 and transfer line speed, and time of free fall descent on the tray 12 after passing the paper discharge roller 3. The time is counted in such a way as to count timing by using timer count due to CPU, and/or clock count of paper discharge motor (stepping motor).

Here, in the arranging action of the arranging member, check whether arrangement of the paper is conducted at front side of the sorting position or arrangement of the paper is conducted at rear side of the sorting position is conducted at check of "shift position: front flag=1?" of STEP P43. Here, when "shift position: front flag" is 0, as illustrated in FIG. 12(*b*), this means that arrangement is conducted at front side than center (paper transfer center O-O) of the tray 12, rear side of arranging member 102*b* is made to operate due to "rear jogger arranging control", so that action of striking the paper to the fixed arranging section 102*a*1 of the arranging member 102*a* is conducted. At this time, the front side of the arranging member 102*a* conduct only excitation for the stepping motor 104*a*, so that position is fixed so as not create gap of position when the paper is struck by the arranging action due to arranging member 102*b* of the rear side. Above actions corresponds to actions from aspect illustrated in FIG. 12(*a*) to aspect illustrated in FIG. 12(*b*).

On the other hand, when result of the check at the STEP P43 indicates that "shift position: front flag" is 1, it means that arrangement is conducted at the rear side than center of the tray 12, so, the arranging member 102*a* is made to operate due to "rear jogger arranging control" of STEP P45, so that action of striking the paper to the fixed arranging member 102*b* of the rear side is conducted while operating the arranging member 102*a* of the front side. This corresponds to action from aspect illustrated in FIG. 13(*a*) to aspect illustrated in FIG. 13(*b*).

Namely, the sorting is conducted in such a way as not to move one side of arranging member and to cause the other side to perform action of reciprocating in the shift direction "c" alternately in every copy, thus, one side of two arranging members is not moved, and the other side is moved to arrange, and set of this operation is conducted alternately in each copy, so that miniaturization of the apparatus is capable of being achieved, and sound from the apparatus can be reduced because operating section is lessened.

Movement of the arranging member in the arranging action is conducted in such a way as to drive the stepping motors 104*a*, 104*b* only by using corresponding set pulse capable of necessary movement amount in accordance with STEP P21, STEP P22 and so forth in FIG. 20.

In STEP P46, condition is checked by using flag and so forth of indicating "jogger action completion" at the time of set pulse completion, after the action of the arranging member is completed, operating flow proceeds to following actions.

After checking of "jogger action completion" at STEP P46, "jogger arranging action timer" is reset at STEP P47, after elapse of constant time from completion of arranging action of the arranging member, at next check of "(jogger arranging action timer)>T2?" of STEP P48, return action of returning the arranging member of movement side at arranging action to acceptance position is conducted.

Before this returning, the arranging member of conducting previous arrangement is made to specify in such a way as to conduct check of "shift position: front flag=1?" again at STEP P49, then the arranging member 102*b* of rear side is returned to the acceptance position at STEP P50, and the arranging member 102*a* of front side is returned to the acceptance position at STEP P51.

Namely, when "shift position: front flag" is 0 at STEP P49, returning action is one in which the arranging member 102*b* is returned from position of FIG. 12(*b*) to position of FIG. 12(*a*), while when "shift position: front flag" is 1 at STEP P49, returning action is one in which the arranging member 102*a* is returned from position of FIG. 13(*b*) to position of FIG. 13(*a*). Similar to STEP P46, check is made about completion of arranging action at STEP P52, jogger arranging control ends.

FIG. 23 is a routine in which, after completing the whole discharge and arrangement of the copy, before arrangement of next copy, the arranging members 102*a*, 102*b* are made to conduct shift action in the shift direction "c". The present routine is executed when "jogger shift action flag" is set to 1 at STEP P32 of FIG. 21 due to shift on signal attached to the top paper of the copy. In this case, in the flow of FIG. 23, first, check of "jogger shift action flag=1?" of top of STEP P60 is judged as yes, followed by proceeding to STEP P61 from STEP P60, after resetting "jogger shift action flag" is 0, proceeding to check of "jogger arranging action complete?" of STEP P62.

STEP P62 is one in which confirmation is made whether the arranging control of arranging members 102*a*, 102*b* is completed to the paper before shifting, after jogger arranging action to the paper is terminated completely shift action is conducted.

After ascertaining that arranging action by using arranging member is completed at STEP P62, at control of "jogger evacuation solenoid On" of STEP P63, as illustrated in FIG. 15, the arranging members 102*a*, 102*b* are made to evacuate from the paper sheaf with the solenoid 115 turned ON to conduct preparation of shift action.

Next, the number of pulse corresponding to shift amount is set at "(jogger movement buffer)←Q" of STEP P64. Movement amount of both the stepping motors 104*a*, 104*b* is the same amount, and Q is value of corresponding movement pulse for the arranging members 102*a*, 102*b* between the acceptance position illustrated in FIG. 12(*a*) and the acceptance position illustrated in FIG. 13(*a*).

Orientation of operating the arranging member is determined at check of "shift position: front flag=1?" of STEP P65, when "shift position:front flag" is 0, the arranging members 102*a*, 102*b* are made to move toward rear side at STEP P66. Namely, the arranging members 102*a*, 102*b* are made to move from the acceptance position illustrated in FIG. 12(*a*) to the acceptance position illustrated in FIG. 13(*a*), then, "shift position:front flag" is set to 1 at STEP P67.

On the contrary, when "shift position:front flag" is 1 of STEP P65, the arranging members 102*a*, 102*b* are made to move toward front side at STEP P68. Namely, the arranging members 102*a*, 102*b* are made to move from the acceptance position illustrated in FIG. 13(*a*) to the acceptance position illustrated in FIG. 12(*a*), then, "shift position:front flag" is set to 0 at STEP P69.

As described above, after conducting shift action of the arranging member, "shift position:front flag" is rewritten, whereby, arrangement direction is always grasped, and shift direction of the arranging member is switched in every time copy is changed.

After ascertaining that the arranging member moves only predetermined shift amount at "jogger action completion" of STEP P70, the arranging member moves to predetermined acceptance position by control of "jogger evacuation solenoid Off" of STEP P71. When the solenoid 115 is turned OFF at STEP P71, for instance, as illustrated in FIG. 13(*a*), wait condition is made that the arranging member 102*a* is placed on the paper sheaf SS of the first copy, and the arranging member 102*b* is placed within the concave section 80*a*. So, shift arranging action due to the arranging member is completed.

In the present example, at the time of sorting/arranging of this time, the acceptance position (FIG. 13(*a*)) of waiting the arranging member 102*a* of operating side before action becomes range of poisoning the paper sheaf SS of the first copy to be the previous copy, thus such acceptance position is located on the paper sheaf SS. Consequently, as illustrated in FIG. 13(*b*), in cases where the arranging member 102*a* moves in order to conduct arranging action on the occasion of the sorting/arranging, the arranging member 102*a* slides upper surface of the paper sheaf SS, so that the arranging member 102*a* does not move from outside of the end section of the paper sheaf SS, therefore, the arranging member does not disturb the paper sheaf SS on the occasion of the arranging action.

Namely, supposing that acceptance position (wait position) of the arranging member should be operated is set to outside from width of the paper sheaf of previous time of copy piled on the tray 12, when arranging action is conducted from such point, the arranging member comes into contact with the paper sheaf of the previous copy to disturb arrangement of the piled paper sheaf. As for means for avoiding this affair, it is necessary to move the arranging member toward upper surface of the paper sheaf of the previous copy in such a way as to conduct a series of operations of evacuation to upward reaches from wait position of being set at outside from width of the paper sheaf→movement of the arranging member→relief action of evacuation of the arranging member, after that, it is necessary to enter the arranging action, thus much times are necessary to conduct arrangement, it introduces danger to lower productivity.

At this point, as the present example, it is possible to prevent disturbance of arrangement of the paper of the previous copy in such a way as to control the acceptance position of the arranging member of the side of conducting arranging action after shifting so as to locate at upper surface of the paper sheaf of the previous copy, and improvement of productivity becomes possible.

[4] Image Forming Apparatus

Figure 24:
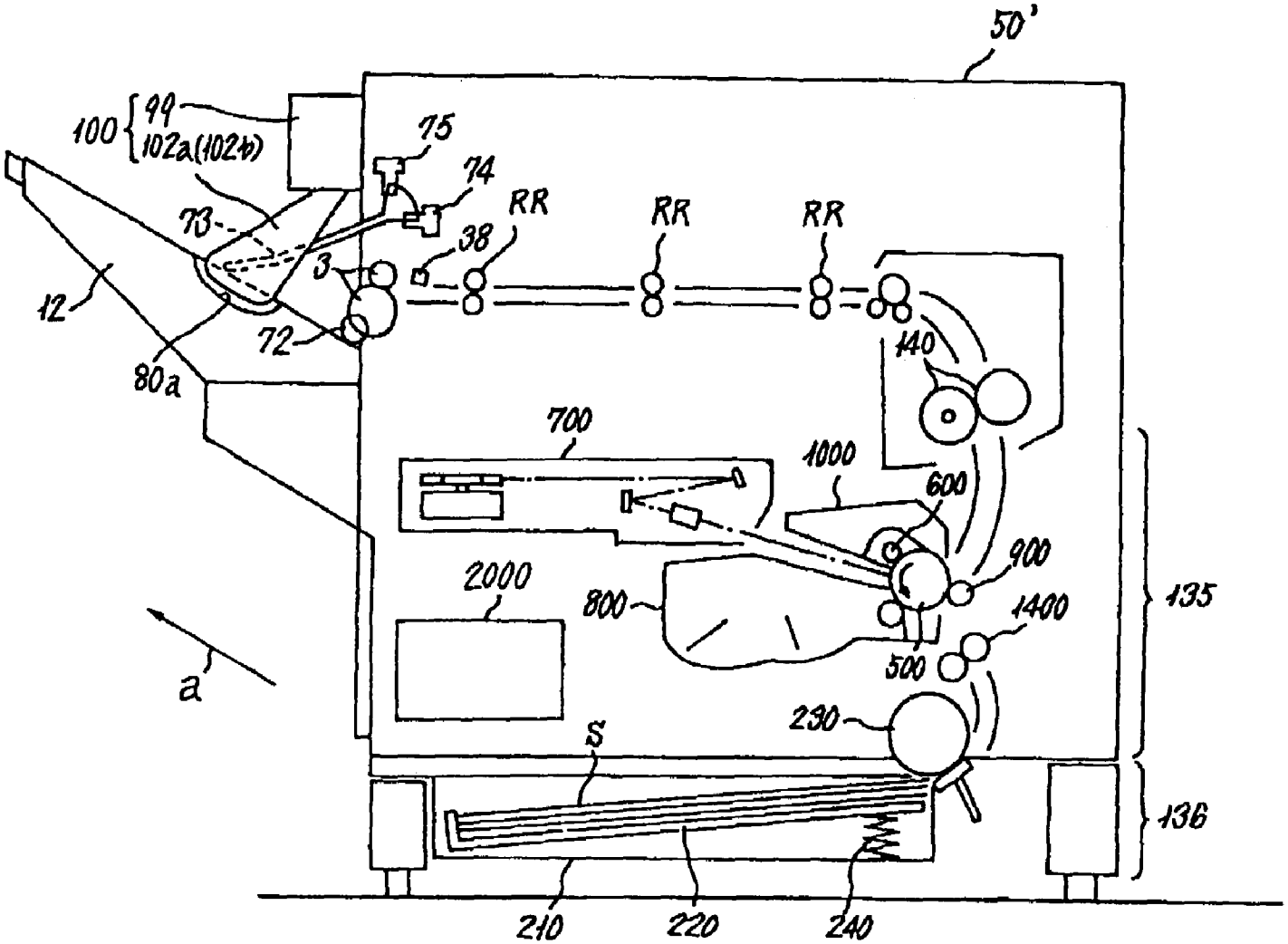
FIG. 24 is a view illustrating an example of an image forming apparatus.
Figure 25:
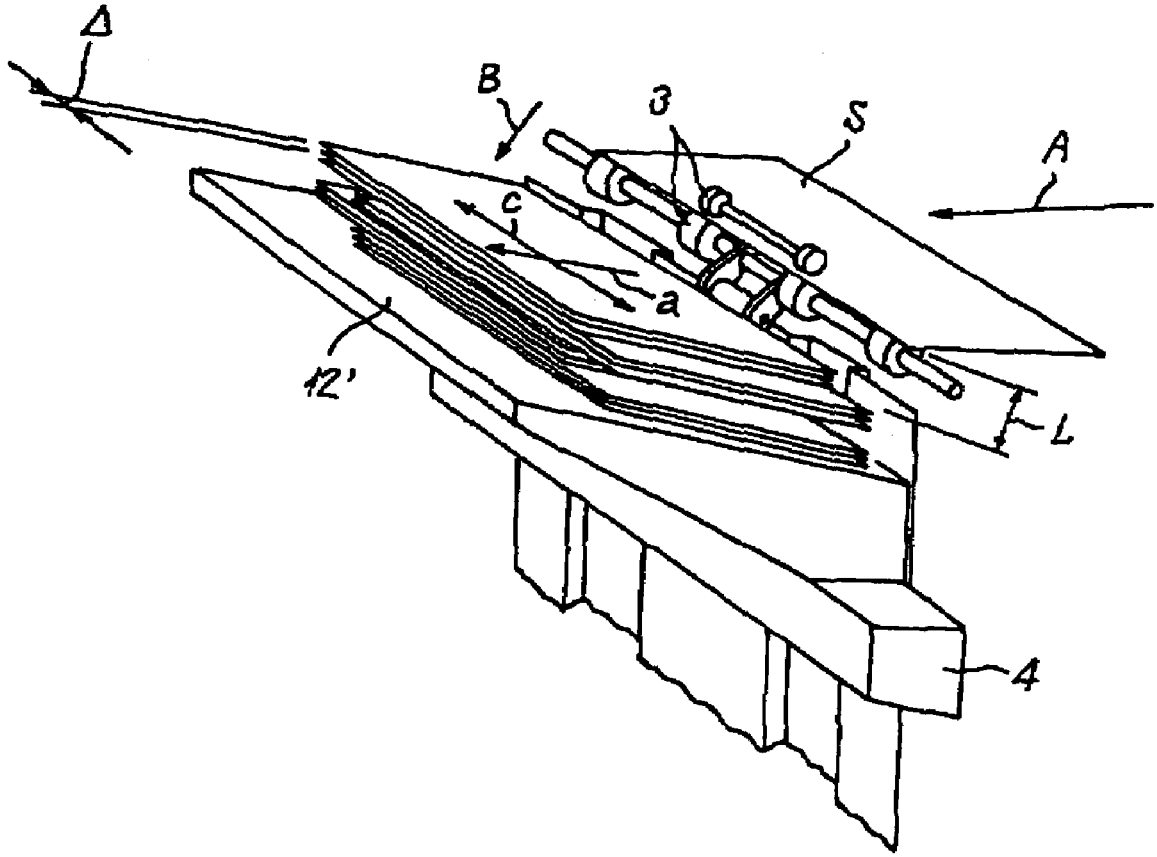
FIG. 25 is a perspective view of circumference of the tray according to the prior art.

The present example is related to the image forming apparatus of having an image forming means for conducting image formation to the paper and a transfer means for transferring the paper of being subjected to image formation, so, an image forming apparatus 50' illustrated in FIG. 24 is provided with a common image forming means to the image forming apparatus 50 in FIG. 1. The image forming apparatus 50' is provided with the paper processing apparatus in accordance with configuration described above.

FIG. 24 illustrates principal members of the image forming means and the paper processing apparatus (sheet-shaped medium processing apparatus). The paper processing apparatus as being contents of the image forming apparatus is provided with common configurations to the paper processing apparatus of being explained in FIG. 1 to FIG. 18, therefore, about the members same as these members in connection with its function, in order to avoid complication, the same signs as that are attached to FIG. 1 to FIG. 18 are attached to members of FIG. 24. They are the paper discharge roller 3, the return roller 72, the tray 12, the paper surface lever 73, the arranging member driving device 99, the arranging means 100, the paper discharge sensor 38, the paper surface sensors 74, 75, the arranging members 102*a*, 102*b* and so forth.

The image forming apparatus 50' will be explained referring to FIG. 24. An image forming section 135 is disposed at approximately center section of the apparatus body, and a paper feeding section 136 is disposed at immediately downward reaches of the image forming section 135. The paper feeding section 136 is provided with a paper feeding cassette 210.

It is possible to dispose a manuscript reading device for reading manuscript at upper section of the image forming apparatus 50' if necessary. At upper section of the image forming section 135, a roller RR as a transfer means for transferring paper of being subjected to image formation, a guide plate and so forth are provided.

An electrical installing unit 2000 for driving the apparatus electrically and for controlling the apparatus is disposed at the image forming section 135. In addition, a drum-shaped photo conductor 500 is disposed. At circumference of the photo conductor 500, an electrifying device 600 for conducting electrifying treatment on surface of the photo conductor 500, an exposure device 700 for conducting projection of image information on surface of the photo conductor by using irradiation of laser light, a development device 800 for forming visible image from electrostatic latent image formed in such a way that exposure is conducted on surface of the photo conductor 500, a transfer device 900 for transferring toner image that is visible image on the photo conductor 500 to the paper, and a cleaning device 1000 for removing toner of remaining on the surface of the photo conductor after transferring to recover, and so forth.

These photo conductor 500, electrifying device 600, exposure device 700, development device 800, transfer device 900, cleaning device 1000 and so forth are principal sections of the image forming means. A fixing device 140 is disposed at approximately upward reaches of the photo conductor 500 and lower reaches of a stream on paper transfer route from the photo conductor 500.

In cases where the image forming apparatus functions as a printer, on the occasion of image formation, image signal is input. The photo conductor 500 is electrified equally by the electrifying device 600 in the dark beforehand. Exposure light is irradiated on the photo conductor 500 of being electrified equally due to light emission of laser diode LD (not illustrated) of the exposure device 700 on the basis of image signal, so, reaches the photo conductor via known polygon mirror and lens, thus electrostatic latent image is formed on surface of the photo conductor 500. The electrostatic latent image moves together with rotation of the photo conductor 500, then, the electrostatic latent image is converted to visible image by the development device 800, further, proceeding to the transfer device 900.

On the other hand, unused paper is accommodated in a paper feeding cassette 210 of the paper feeding section 136, so, a bottom plate 220 is pressurized by a spring 240 in such a way that the paper S of the top position on the bottom plate 220 that is supported rotatably is pressed to a paper feeding roller 230. On the occasion of paper feeding for transfer, the paper feeding roller 230 rotates, due to this rotation, the paper S is send out from the paper feeding cassette 210, followed by being conveyed to one pair of resisting rollers 1400.

The paper sent to the resisting rollers 1400 is stopped its conveyance temporarily. The resisting rollers 1400 start conveyance of the paper while timing so that position relationship between toner image on the surface of the photo conductor 500 and the pointed head of the paper S becomes transfer position of being provided the transfer device 900 that is predetermined position appropriate to image transfer.

On the paper after transfer, the toner image is fixed during the paper goes through the fixing device 140. The paper passed through the fixing device 140 conveyed by the roller RR to be a conveyance means, via the paper discharge sensor 38, thus, the paper is discharged to the tray 12 from the paper discharge roller 3.

About following function of paper arrangement due to the paper processing apparatus, since it is the same contents as that described above, explanation thereof will be omitted.

Also in the image forming apparatus of the present example, it is possible to arrange the paper S piled on the tray with a high degree of precision by using the arranging means 100.

What is claimed is:

1. A sheet shaped medium processing apparatus comprising:

an arranging device including a first arranging member and a second arranging member; and a transferring device configured to transfer at least one sheet shaped medium between said first arranging member and said second arranging member, wherein said first arranging member is configured to move to strike one end of the sheet shaped medium toward the second arranging member when said second arranging member is stopped, wherein said second arranging member is configured to move to strike an opposite end of the sheet shaped medium toward the first arranging member when said first arranging member is stopped, wherein said second arranging member is configured to move to strike the sheet shaped medium toward the first arranging member after said first arranging member is configured to move to strike the sheet shaped medium with a predetermined timing, and wherein the sheet shaped medium is arranged by striking the one end of the sheet shaped medium by means of the first arranging member and the opposite end of the sheet shaped medium by means of the second arranging member.

2. The sheet shaped medium processing apparatus according to claim 1, further comprising a tray, wherein the transferring device is configured to transfer the sheet shaped medium to the tray.

3. The sheet shaped medium processing apparatus according to claim 1, wherein striking the sheet shaped medium is alternately exchanged between said first and second arranging members with a predetermined number.

4. A sheet shaped medium processing apparatus comprising:

an arranging device comprising first and second arranging members; and a transferring device configured to transfer at least one sheet shaped medium between the first arranging member and the second arranging member, wherein the first arranging member is configured to move to strike one end of the sheet shaped medium toward the second arranging member when the second arranging member is in a first position, wherein the second arranging member is configured to move to strike an opposite end of the sheet shaped medium toward the first arranging member when the first arranging member is in a second position, and wherein said second arranging member is configured to move to strike the sheet shaped medium toward the first arranging member after said first arranging member is configured to move to strike the sheet shaped medium with a predetermined timing, and wherein the sheet shaped medium is arranged by striking the one end of the sheet shaped medium by means of the first arranging member and the opposite end of the sheet shaped medium by means of the second arranging member.

5. A sheet shaped medium processing apparatus comprising:

an arranging device including a first arranging member and a second arranging member; and a transferring device configured to transfer sheet shaped mediums between said first arranging member and said second arranging member, wherein said first arranging member strikes one end of a first sheet shaped medium toward the second arranging member when said second arranging member is stopped, wherein said second arranging member strikes an opposite end of a second sheet shaped medium, when the second sheet shaped medium is stacked on top of the first sheet shaped medium, toward the first arranging member when said first arranging member is stopped, and wherein said second arranging member strikes the second sheet shaped medium toward the first arranging member after said first arranging member strikes the first sheet shaped medium with a predetermined timing.

6. The sheet shaped medium processing apparatus according to claim 5, further comprising a tray, wherein the transferring device is configured to transfer the sheet shaped mediums to the tray.

7. The sheet shaped medium, processing apparatus according to claim 5, wherein striking the sheet shaped mediums is alternately exchanged between said first and second arranging members with a predetermined number.

8. A sheet shaped medium processing apparatus comprising:

an arranging device comprising first and second arranging members; and a transferring device configured to transfer sheet shaped mediums between the first arranging member and the second arranging member, wherein the first arranging member strikes one end of a first sheet shaped medium toward the second arranging member when the second arranging member is in a first position, wherein the second arranging member strikes an opposite end of a second sheet shaped medium, when the second sheet shaped medium is stacked on top of the first sheet shaped medium, toward the first arranging member when the first arranging member is in a second position, and wherein said second arranging member strikes the second sheet shaped medium toward the first arranging member after said first arranging member strikes the first sheet shaped medium with a predetermined timing.

9. The sheet shaped processing apparatus according to claim 8, further comprising a final stacking tray, wherein the first and second arranging members are configured to strike and arrange sheet shaped mediums provided on said final stacking tray.

10. The sheet shaped medium processing apparatus according to claim 9, further comprising means for adjusting a vertical position of said final stacking tray.

11. The sheet shaped medium processing apparatus according to claim 9, wherein said final stacking tray includes concave section that are recessed beneath a sheet shaped medium receiving surface of said final stacking tray, and wherein said concave sections are configured to receive a respective one of said first and second arranging members.

12. The sheet shaped medium processing apparatus according to claim 8, wherein said first and second arranging members are slidably mounted on a guide shaft.

13. The sheet shaped medium processing apparatus according to claim 12, wherein said first and second arranging members are pivotably mounted on said guide shaft, and wherein a height of said first and second arranging members can be adjusted by pivoting said first and second arranging members on said guide shaft.

14. The sheet shaped medium processing apparatus according to claim 5, further comprising a final stacking tray, wherein the first and second arranging members are configured to strike and arrange sheet shaped mediums provided on said final stacking tray.

15. The sheet shaped medium processing apparatus according to claim 14, further comprising means for adjusting a vertical position of said final stacking tray.

16. The sheet shaped medium processing apparatus according to claim 14, wherein said final stacking tray includes a concave sections that are recessed beneath a sheet shaped medium receiving surface of said final stacking tray, and wherein said concave sections are configured to receive a respective one of said first and second arranging members.

17. The sheet shaped medium processing apparatus according to claim 5, wherein said first and second arranging members are slidably mounted on a guide shaft.

18. The sheet shaped medium processing apparatus according to claim 17, wherein said first and second arranging members are pivotably mounted on said guide shaft, and wherein a height of said first and second arranging members can be adjusted by pivoting said first and second arranging members on said guide shaft.

* * * * *